US012180975B2

(12) United States Patent
Smith

(10) Patent No.: US 12,180,975 B2
(45) **Date of Patent: *Dec. 31, 2024**

(54) FRUIT OR VEGETABLE SHAPED FAN FOR DISPERSING AIRBORNE EYE IRRITANTS

(71) Applicant: Glenn B. Smith, Cleveland, GA (US)

(72) Inventor: Glenn B. Smith, Cleveland, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/620,176

(22) Filed: Mar. 28, 2024

(65) Prior Publication Data

US 2024/0247663 A1 Jul. 25, 2024

Related U.S. Application Data

(62) Division of application No. 17/830,447, filed on Jun. 2, 2022, now Pat. No. 11,946,488.

(51) Int. Cl.

| | |
|---|---|
| ***F04D 29/52*** | (2006.01) |
| ***F04D 25/06*** | (2006.01) |
| ***F04D 27/00*** | (2006.01) |
| ***F04D 29/70*** | (2006.01) |

(52) U.S. Cl.

CPC ..... *F04D 29/522* (2013.01); *F04D 25/0673* (2013.01); *F04D 27/00* (2013.01); *F04D 29/703* (2013.01)

(58) Field of Classification Search

CPC .... F04D 19/002; F04D 25/0673; F04D 27/00; F04D 29/005; F04D 29/325; F04D 29/329; F04D 29/522; F04D 29/545; F04D 29/703; F04F 5/16; F04F 5/20

USPC ..... 417/53, 88, 89

See application file for complete search history.

(56) References Cited

U.S. PATENT DOCUMENTS

| | | | | |
|---|---|---|---|---|
| 2,583,374 A * | 1/1952 | Hoffman | F04F 5/16 | 454/351 |
| 2,931,562 A * | 4/1960 | Wistrand | F04D 29/4226 | 392/379 |
| 4,272,261 A * | 6/1981 | Lynch, Jr. | A61L 9/122 | 55/472 |
| 4,546,496 A * | 10/1985 | Lewis | A42C 5/04 | 2/436 |
| 4,797,072 A * | 1/1989 | Berfield | A47L 7/0042 | 15/329 |
| 4,880,364 A * | 11/1989 | Berfield | A47L 5/14 | 417/423.1 |

(Continued)

*Primary Examiner* — Charles G Freay
*Assistant Examiner* — Benjamin Doyle
(74) *Attorney, Agent, or Firm* — H. Brock Kolls

(57) ABSTRACT

The present invention relates to a fruit or vegetable shaped fan for dispersing airborne eye irritants that are released during cutting fruits or vegetables. The fan includes a base that is wedge-shaped, an air inflow collimator that is fruit or vegetable shaped having an open front end, an internal frame that is configured to provide minimal abatement to airflow through the air inflow collimator, a motor mount that secures a motor, a fan blade that attaches to the motor, and a grill that attaches to the open front end of the air inflow collimator. The fan is configured to disperse airborne eye irritants away from a user's eyes. Airborne eye irritants are released when certain fruits and vegetables are chopped or otherwise cut. Such fruits and vegetables that can release airborne eye irritants when cut include onions, peppers, and certain other fruits and vegetables.

20 Claims, 17 Drawing Sheets

(56) References Cited

U.S. PATENT DOCUMENTS 5,181,832 A * 1/1993 Reents ..... F04D 29/601 417/423.9
5,561,862 A * 10/1996 Flores, Sr. ..... A42B 3/286 2/422
6,168,517 B1 * 1/2001 Cook ..... F24F 13/04 55/467
6,309,192 B1 * 10/2001 Litvin ..... F04D 25/06 415/213.1
6,361,590 B1 * 3/2002 Gilbert, Jr. ..... B01D 46/24 55/385.2
7,381,129 B2 * 6/2008 Avedon ..... F04D 29/542 416/247 R
8,926,414 B1 * 1/2015 Kirkpatrick ..... G06F 1/203 361/679.41
9,352,064 B2 * 5/2016 Furner ..... A61L 9/122
9,702,576 B2 * 7/2017 Avedon ..... F24F 7/007
9,861,142 B1 * 1/2018 Rebecchi ..... F04D 29/403
10,024,531 B2 * 7/2018 Avedon ..... F21V 33/0096
10,378,558 B2 * 8/2019 Sharma ..... F04D 17/16
10,551,873 B2 * 2/2020 Han ..... G06F 1/1632
10,739,822 B2 * 8/2020 Choi ..... H02J 50/10
10,876,545 B2 * 12/2020 Ediger ..... F04D 19/002
10,920,792 B2 * 2/2021 Xiao ..... B01D 46/0047
11,071,881 B1 * 7/2021 Cullen ..... A41D 13/0025
11,480,362 B2 * 10/2022 Bae ..... B01D 46/42
2004/0047743 A1 * 3/2004 Dooley ..... F04D 25/08 417/234
2005/0013711 A1 * 1/2005 Goyetche ..... B01D 46/62 417/313
2006/0201119 A1 * 9/2006 Song ..... B01D 53/007 55/471
2007/0034082 A1 * 2/2007 Adair ..... B03C 3/155 96/97
2007/0277487 A1 * 12/2007 Thurin ..... B01D 46/0035 55/471
2010/0064895 A1 * 3/2010 Thurin ..... F24F 8/80 96/222
2011/0038761 A1 * 2/2011 Saleh ..... A61L 9/122 422/124
2012/0195749 A1 * 8/2012 Avedon ..... F04D 29/547 415/211.2
2012/0288414 A1 * 11/2012 Shi ..... A01M 1/2055 422/124
2013/0189129 A1 * 7/2013 Genereux ..... F04D 25/0613 417/313
2014/0017069 A1 * 1/2014 Peters ..... F04D 25/08 415/126
2014/0268542 A1 * 9/2014 Moon ..... H01R 13/44 361/679.41
2015/0075445 A1 * 3/2015 Shi ..... A01M 13/00 119/712
2015/0252812 A1 * 9/2015 Sauer ..... F04D 29/646 415/220
2015/0273376 A1 * 10/2015 Sohn ..... B01D 46/62 96/418
2016/0032942 A1 * 2/2016 Jung ..... F04D 19/002 415/148
2016/0282152 A1 * 9/2016 Khen ..... G01T 1/20
2017/0246579 A1 * 8/2017 Mun ..... A61L 9/22
2017/0321715 A1 * 11/2017 Park ..... B01D 46/0047
2017/0342999 A1 * 11/2017 Kamrath ..... F04D 1/14
2018/0223864 A1 * 8/2018 Chou ..... F04D 29/667
2018/0288898 A1 * 10/2018 Jeong ..... G06F 1/206
2019/0320251 A1 * 10/2019 Mohammed ..... F04D 29/005
2021/0285686 A1 * 9/2021 Park ..... F04D 25/08
2022/0010799 A1 * 1/2022 Park ..... F04D 29/444
2023/0125958 A1 * 4/2023 Fanning ..... F24F 11/79

* cited by examiner 102
112
182
118
178
126
206
130
180
122
138
132
126
148
142
130
180
104
170
160
108
158
146
150
174
106B
126
164
114
156
114
156
154
152
106A
116

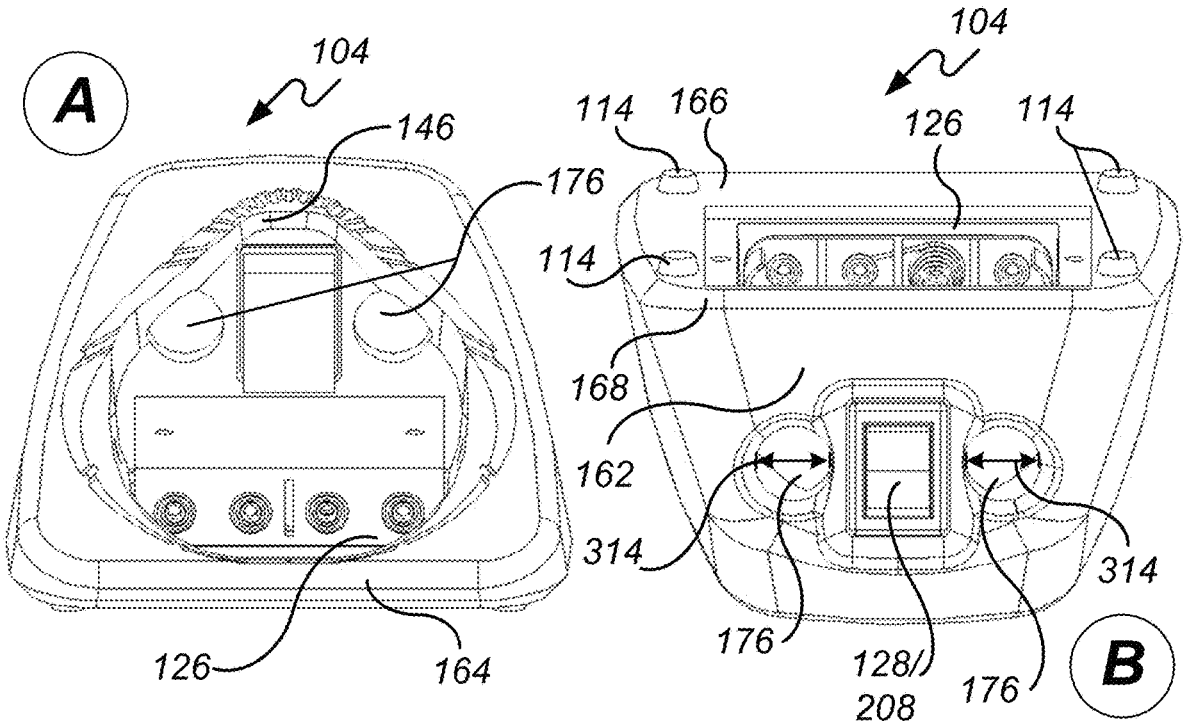
Fig. 8
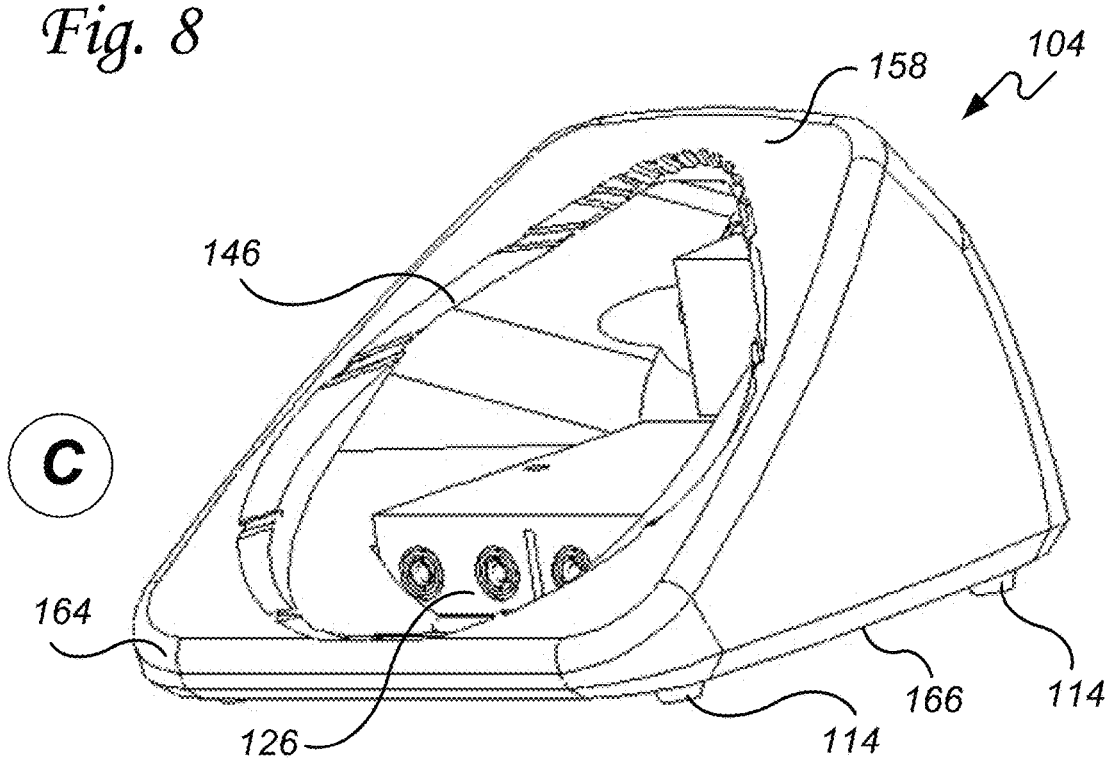

FRUIT OR VEGETABLE SHAPED FAN FOR DISPERSING AIRBORNE EYE IRRITANTS

CROSS-REFERENCE TO RELATED APPLICATIONS

This application contains subject matter which is related to the subject matter of the following co-pending application. The below-listed application is hereby incorporated herein by reference in its entirety:

This is a U.S. non-provisional application is a divisional of a U.S. non-provisional application Ser. No. 17/830,447, inventor Glenn B. Smith, entitled "FRUIT OR VEGETABLE SHAPED FAN FOR DISPERSING AIRBORNE EYE IRRITANTS", filed Jun. 2, 2022, which claims the benefit of a U.S. provisional application, Ser. No. 63/208,502, inventor Glenn B. Smith, entitled "VEGETABLE SHAPED FAN FOR DISPERSING AIRBORNE EYE IRRITANTS", filed Jun. 9, 2021.

TECHNICAL FIELD OF THE INVENTION

This invention relates to a fruit or vegetable shaped fan configured for dispersing airborne eye irritants away from a user. The airborne eye irritants are released during cutting of the fruits or vegetables. Such fruits and vegetables that can release airborne eye irritants when cut include onions, peppers, and certain other fruits and vegetables.

BACKGROUND OF THE INVENTION

Before our invention, a shortcoming of cutting certain fruits or vegetables such as onions or peppers was that the process of cutting the fruits or vegetables released airborne eye irritant substances that could easily travel to a user's eyes and become extremely irritating causing red watering eyes. The present invention addresses these and other shortcomings by providing a fruit or vegetable shaped fan configured for dispersing away from a user airborne eye irritants that are released during cutting fruits or vegetables, and other advantages. For these reasons and shortcomings as well as other reasons and shortcomings there is a long-felt need that gives rise to the present invention.

SUMMARY OF THE INVENTION

The shortcomings of the prior art are overcome and additional advantages are provided through the provision of a fruit or vegetable shaped fan for dispersing airborne eye irritants that are released during the cutting of fruits or vegetables. The fruit or vegetable shaped fan comprises a base that is wedge-shaped having a receiving orifice on a front surface, a bottom surface, and a rear surface having a plurality of macro airflow holes. The front surface descends down the wedge shape forming a front edge at the bottom surface that is proximate to a work surface that the fruit or vegetable shaped fan sits on.

An air inflow collimator that is fruit or vegetable shaped has an open front end and a backend. The air inflow collimator forms an interior perimeter. The air inflow collimator comprises a fastener mount and a mounting attachment at the backend that is sized and shaped to insert into the receiving orifice. The air inflow collimator has a plurality of micro airflow holes disposed proximate to the mounting attachment and a plurality of macro airflow channels through the mounting attachment that align with the plurality of macro airflow holes.

An internal frame is configured to provide minimal abatement to airflow through the air inflow collimator by being mostly hollow. The internal frame comprises a perimeter ring that is sized and shaped to fit along a portion of the interior perimeter, a plurality of braces, a first motor receptacle having at least one of a first motor fastener mount, and a fastening ring. Each of the plurality of braces, the first motor receptacle, the first motor fastener mount, and the fastening ring are integrally formed into the internal frame. The internal frame is fitted into the interior of the air inflow collimator and fastened by way of the fastening ring to the fastener mount.

A motor mount comprises a second motor receptacle having at least one of a second motor fastener mount. A motor fits between the first motor receptacle and the second motor receptacle and is secured into place by one or more of a fastener that connects the first motor fastener mount to the second motor fastener mount. A fan blade attaches to the motor. A grill attaches to the open front end of the air inflow collimator enclosing the internal frame, the motor mount, the motor, and the fan blade inside the air inflow collimator.

Additional shortcomings of the prior art are overcome and additional advantages are provided through the provision of a fruit or vegetable shaped fan for dispersing airborne eye irritants that are released during cutting fruits or vegetables. The fruit or vegetable shaped fan comprises a base that is wedge-shaped having a receiving orifice on a front surface, a bottom surface, and a rear surface having a plurality of macro airflow holes. The front surface descends down the wedge shape forming a front edge at the bottom surface that is proximate to a work surface that the fruit or vegetable shaped fan sits on.

An air inflow collimator is a fruit or vegetable shape having an open front end and a backend. The air inflow collimator forms an interior perimeter. The air inflow collimator comprises a fastener mount and a mounting attachment at the backend that is sized and shaped to insert into the receiving orifice. The air inflow collimator has a plurality of micro airflow holes positioned in a semi-circular arrangement proximate seam between the mounting attachment and the receiving orifice at the backend close to the working surface, and a plurality of macro airflow channels through the mounting attachment that aligns with the plurality of macro airflow holes on the rear surface.

An internal frame is configured to provide minimal abatement to airflow through the air inflow collimator. The internal frame comprises a perimeter ring that is sized and shaped to fit along a portion of the interior perimeter, a plurality of braces, a first motor receptacle having at least one of a first motor fastener mount, and a fastening ring. Each of the plurality of braces, the first motor receptacle, the first motor fastener mount, and the fastening ring are integrally formed into the internal frame. The internal frame is fitted into the interior of the air inflow collimator and fastened by way of the fastening ring to the fastener mount.

A motor mount comprises a second motor receptacle having at least one of a second motor fastener mount. A motor fits between the first motor receptacle and the second motor receptacle and is secured into place by one or more of a fastener that connects the first motor fastener mount to the second motor fastener mount. A fan blade attaches to the motor. A grill attaches to the open front end of the air inflow collimator enclosing the internal frame, the motor mount, the motor, and the fan blade inside the air inflow collimator.

Additional shortcomings of the prior art are overcome and additional advantages are provided through the provision of a method of using a fruit or vegetable shaped fan to disperse airborne eye irritants that are released during cutting fruits or vegetables. The method comprises the steps of turning on the fruit or vegetable shaped fan. The fruit or vegetable shaped fan comprises a base that is wedge-shaped having a receiving orifice on a front surface, a bottom surface, and a rear surface having a plurality of macro airflow holes. The front surface descends down the wedge shape forming a front edge at the bottom surface that is proximate to a work surface the fruit or vegetable shaped fan sits on. An air inflow collimator is fruit or vegetable shaped having an open front end and a backend. The air inflow collimator forms an interior perimeter. The air inflow collimator comprises a fastener mount and a mounting attachment at the backend that is sized and shaped to insert into the receiving orifice. The air inflow collimator has a plurality of micro airflow holes disposed proximate to the mounting attachment and a plurality of macro airflow channels through the mounting attachment that align with the plurality of macro airflow holes. An internal frame is configured to provide minimal abatement to airflow through the air inflow collimator. The internal frame comprises a perimeter ring that is sized and shaped to fit along a portion of the interior perimeter, a plurality of braces, a first motor receptacle having at least one of a first motor fastener mount, and a fastening ring. Each of the plurality of braces, the first motor receptacle, the first motor fastener mount, and the fastening ring are integrally formed into the internal frame. The internal frame is fitted into the interior of the air inflow collimator and fastened by way of the fastening ring to the fastener mount. A motor mount comprises a second motor receptacle having at least one of a second motor fastener mount. A motor fits between the first motor receptacle and the second motor receptacle and is secured into place by one or more of a fastener that connects the first motor fastener mount to the second motor fastener mount. A fan blade attaches to the motor, and a grill attaches to the open front end of the air inflow collimator enclosing the internal frame, the motor mount, the motor, and the fan blade inside the air inflow collimator.

The method continues by positioning the fruit or vegetable shaped fan on a work surface proximate to one or more of a fruit or vegetable. And, cutting the fruit or vegetable in a manner that airborne eye irritants are released from the fruit or vegetable and dispersed away from the user by way of the fruit or vegetable shaped fan.

Additional features and advantages are realized through the techniques of the present invention. Other embodiments and aspects of the invention are described in detail herein and are considered a part of the claimed invention. For a better understanding of the invention with advantages and features, refer to the description and the drawings.

BRIEF DESCRIPTION OF THE FIGURES

The foregoing and other objects, features, and advantages of the invention are apparent from the following detailed description taken in conjunction with the accompanying drawings in which:

FIG. 8 illustrates one example of a base;

The detailed description explains the preferred embodiments of the invention, together with advantages and features, by way of example with reference to the drawings.

DETAILED DESCRIPTION OF THE INVENTION

Figure 1:
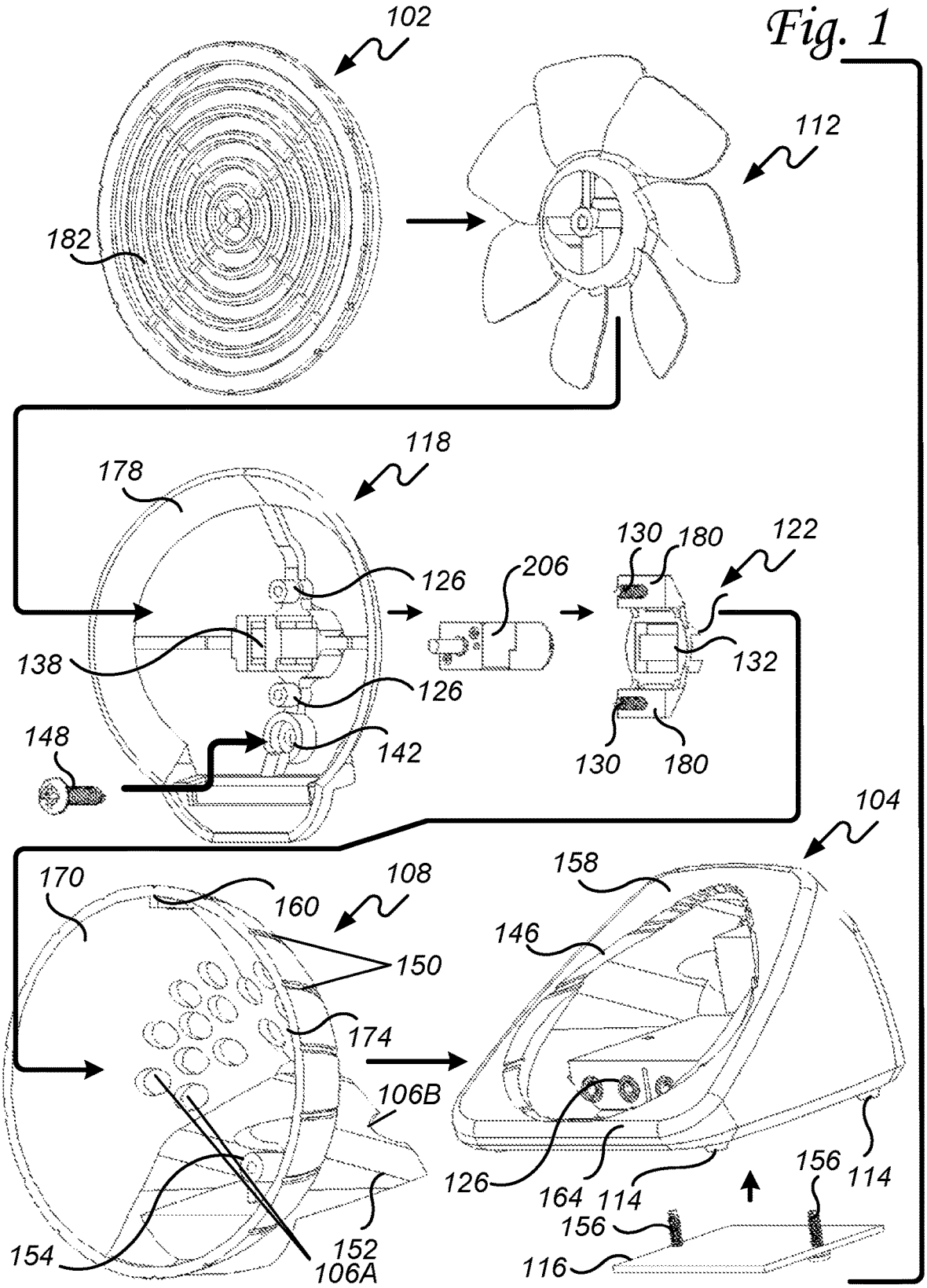
FIG. 1 illustrates one example of an assembly view of a fruit or vegetable shaped fan.

Turning now to the drawings in greater detail, it will be seen that in FIG. 1 there is illustrated one example of a fruit or vegetable shaped fan 100 for dispersing airborne eye irritants 308 away from a user 310 that are released during the cutting of fruits or vegetables. The fruit or vegetable shaped fan 100 comprises a base 104 that is wedge-shaped having a receiving orifice 146 in a front surface 158, a bottom surface 166, and a rear surface 162 having a plurality of macro airflow holes 176. The front surface 158 descends down the wedge shape forming a front edge 164 at the bottom surface 166 that is proximate to a work surface 304 that the fruit or vegetable shaped fan 100 sits on.

An air inflow collimator 108 is fruit or vegetable shaped 100 and has an open front end 170 and a backend 172. The air inflow collimator 108 forms an interior perimeter 174. The air inflow collimator 108 comprises a fastener mount 154, and a mounting attachment 152 at the backend 172 that is sized and shaped to insert into the receiving orifice 146. The air inflow collimator 108 has a plurality of micro airflow holes 106A disposed proximate to the mounting attachment 152 and a plurality of macro airflow channels 106B through the mounting attachment 152 that align with the plurality of macro airflow holes allowing air to pass from the rear surface 162 through the plurality of macro airflow channels into the interior of the air inflow collimator 108 and through the fan blades 112, exiting the grill 102.

An internal frame 118 is configured to provide minimal abatement to airflow through the air inflow collimator 108. In this regard, the internal frame 118 comprises a perimeter ring 178 that is sized and shaped to fit along a portion of the interior perimeter 174, a plurality of braces 124, a first motor receptacle 138 having at least one of a first motor fastener mount 126, and a fastening ring 144. Each of the plurality of braces 124, the first motor receptacle 138, the first motor fastener mount 126, and the fastening ring 144 are integrally formed into the internal frame 118. The internal frame 118 is fitted into the interior of the air inflow collimator 108 and fastened 148 by way of the fastening ring 144 to the fastener mount 154. Such fastener 148 can be a screw or other types and kinds of fasteners as may be required and/or desired in a particular embodiment.

A motor mount 122 comprises a second motor receptacle 132 having at least one of a second motor fastener mount 130. A motor 120 fits between the first motor receptacle 138 and the second motor receptacle 132 and is secured into place by one or more of a fastener 130 that connects the first motor fastener mount 126 to the second motor fastener mount 180. A fan blade 112 attaches to the motor and a grill 102 attaches to the open front end 170 of the air inflow collimator 108 enclosing the internal frame 118, the motor mount 122, the motor 120, and the fan blade 112 inside the air inflow collimator 108.

In an exemplary embodiment, a battery compartment 126 is integrally formed in the bottom surface 166 of the base 104 and stores the power supply 204 which can be batteries or other power sources as may be required and/or desired in a particular embodiment. A cover 116 encloses the power supply 166 within the battery compartment 126. A plurality of cover fasteners 156 can be used to secure the cover 116 to the base 104. Such plurality of cover fasteners 156 can be screws or other types and kinds of fasteners.

Figure 2A:
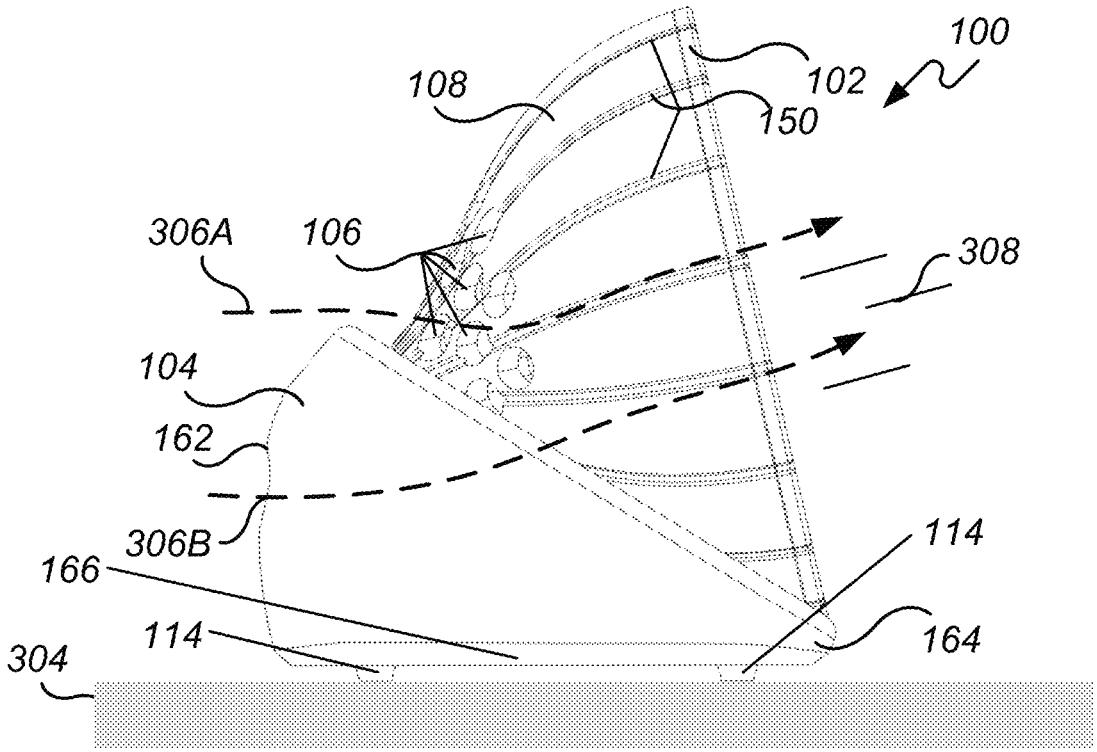
FIGS. 2A and 2B illustrate a left side view of a fruit or vegetable shaped fan and airflow configuration.
Figure 2B:
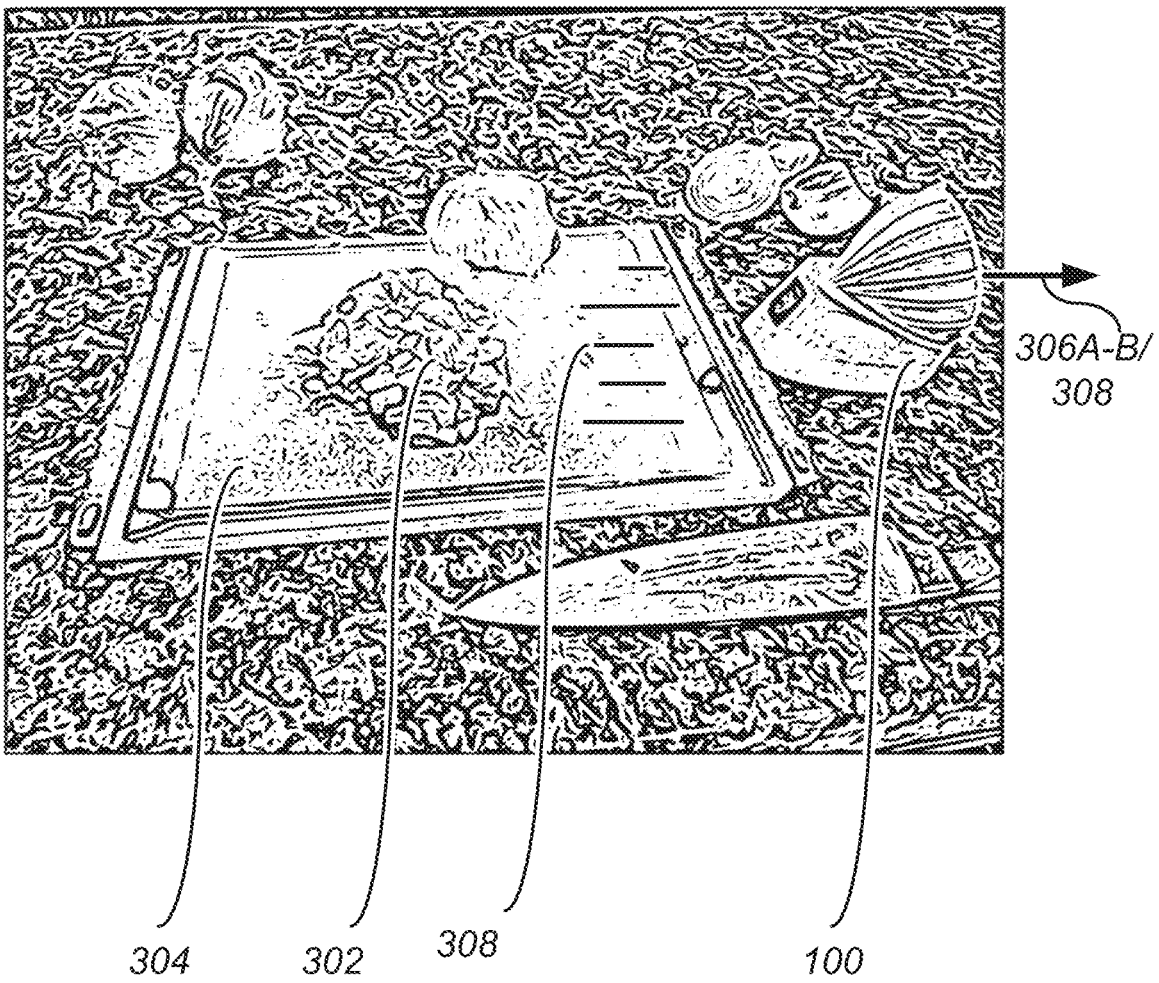
Figure 2B:
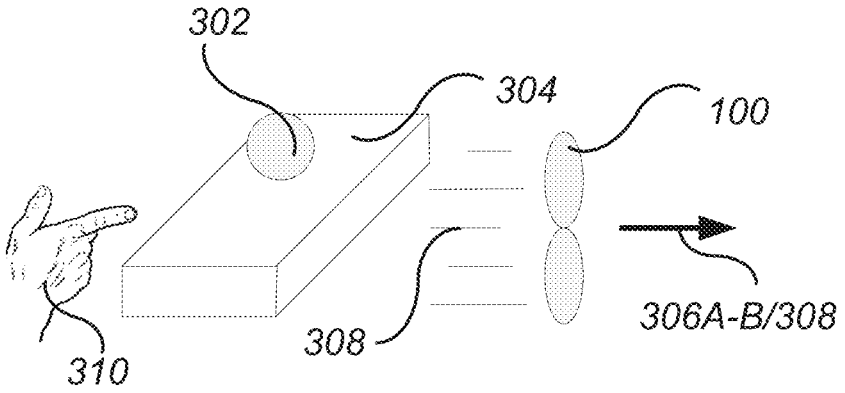

Referring to FIGS. 2A-2B, there is illustrated a left side view of a fruit or vegetable shaped fan 100 and airflow 306 configuration. In an exemplary embodiment, the fruit or vegetable shaped fan 100 including is various parts such as the base 104, the air inflow collimator 108, the internal frame 118, the motor mount 122, the grill 102, and other parts that can be manufactured in a variety of different sizes small to large, and from a variety of different materials including plastics, metals, and other materials. In addition, such parts can be manufactured by techniques such as injection molding, 3D printing, and other manufacturing techniques, as may be required and/or desired in a particular embodiment.

The fruit or vegetable shaped fan 100 can be positioned proximate to a work surface 304 and configured to evacuate or otherwise disperse airborne eye irritants 308 that are released during the cutting of onions, pepper, and other fruits and vegetables 302. Such work surfaces 304 can include cutting boards, countertops, and other types and kinds of work surfaces as may be required and/or desired in a particular embodiment.

With reference to FIG. 2A, a base 104 is wedge-shaped having a receiving orifice 146 in a front surface 158 for receiving an air inflow collimator 108. Better illustrated in at least FIG. 8, the base 104 has a front edge 164, a rear edge 168, a plurality of feet 114 which come in contact with the work surface 304, and a plurality of macro airflow holes 176 in a rear surface 162 that matchup or otherwise aligns with a plurality of macro airflow channels 106B in the air inflow collimator 108 when the air inflow collimator 108 is inserted into the receiving orifice 146 of the base 104. Airflow 306B enters the air inflow collimator 108 by way of the plurality of macro airflow holes 176 in the rear surface 162, through the plurality of macro airflow channels 106, and is accelerated by way of fan blade 112 out through grill 102 dispersing airborne eye irritants 308 from the work surface 304 that are released during the cutting of fruits or vegetables.

Figure 9:
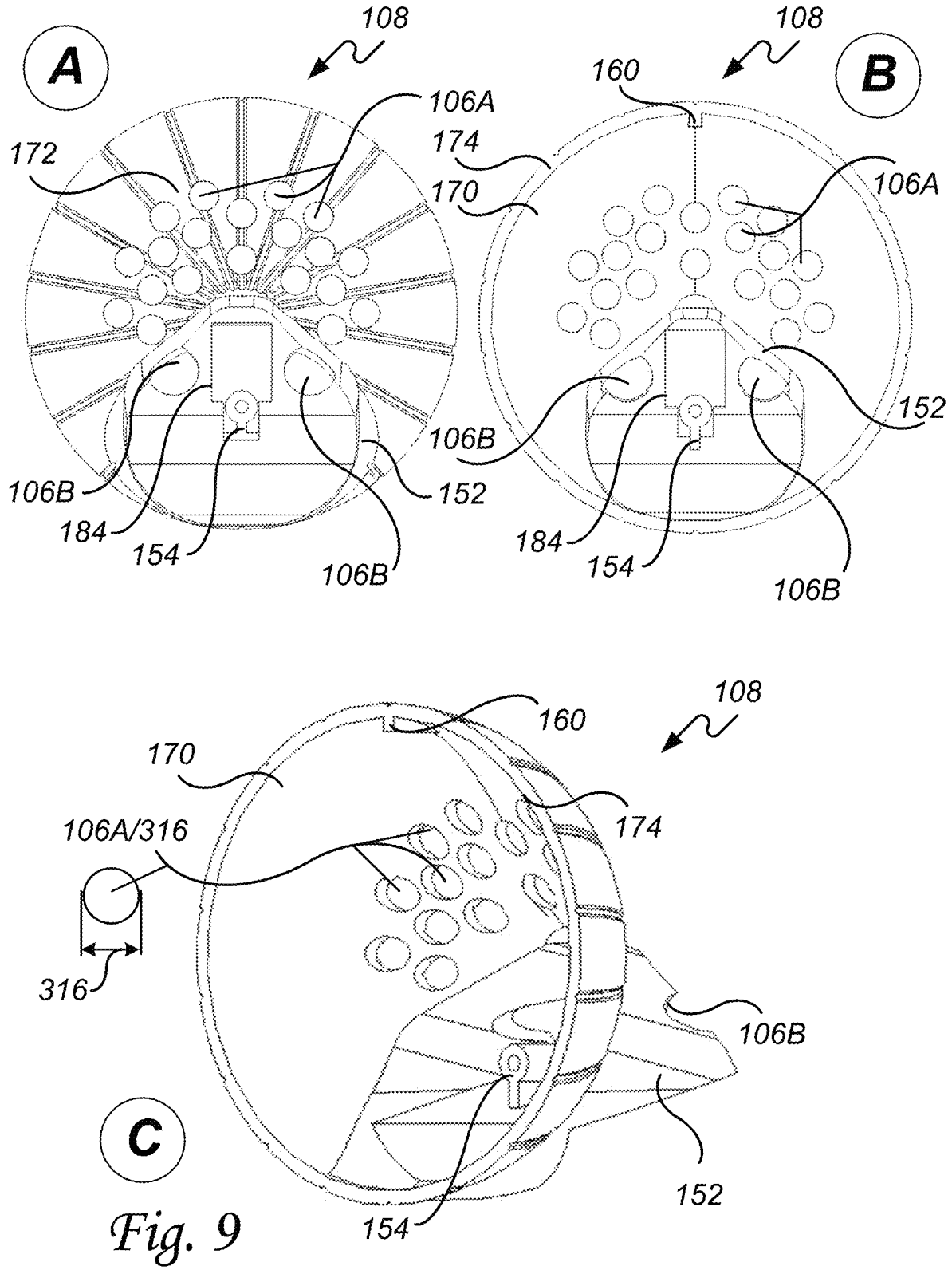
FIG. 9 illustrates one example of an air inflow collimator.

Better illustrated in at least FIG. 9, the air inflow collimator 108 has an open front end 170, a backend 172, and a plurality of micro airflow holes 106 disposed along the backend 172 through which airflow 306A enters the air inflow collimator 108 and is accelerated by way of fan blade 112 out through grill 102 dispersing airborne eye irritants 308 from the work surface 304 that are released during the cutting of fruits or vegetables.

In an exemplary embodiment, the plurality of macro airflow holes 176 aligns with the plurality of macro airflow channels 106B. The diameter 314 of the plurality of macro airflow holes 176 and the plurality of macro airflow channels 106B are larger than the diameter 316 of the plurality of micro airflow holes. The plurality of macro airflow holes 176 inlets is on the rear surface 162 close to the working surface 304 where the fruit or vegetable shaped fan 100 sits during the cutting of fruits or vegetables 302, drawing eye irritants 308 that originate from cutting vegetables on the work surface 304 away from a user 310.

In this regard, in an exemplary embodiment, the diameter of the plurality of macro airflow holes 176 and the diameter of the plurality of macro airflow channels 106B are larger than the diameter of the plurality of micro airflow holes 106A, increasing air inflow through the plurality of macro airflow holes 176 which are located on the rear surface 162 closest to the working surface 304 and source of airborne eye irritants 308 where the fruit or vegetable shaped fan 100 sits during cutting of fruits or vegetables 302.

In an exemplary embodiment, the surface area of the plurality of micro holes 106A plus the surface area of the plurality of macro holes 106B is less than the surface area of the open front end 170 increasing the velocity of inflow air 306A-B versus outflow air through the grill 102 causing an increased range of harvest of airborne eye 308 irritants from the work surface 304 and slowing airborne eye irritant 308 dispersion velocity away from the user 310 reducing the chance that dispersing airborne eye irritants 308 that are released during the cutting of the fruits or vegetables 302 unintentionally reach the eyes of the user 310.

In an exemplary embodiment, the air inflow collimator 108 can be shaped like a fruit or vegetable and the outer surface can be colored and textured 150 to better define the type or kind of fruit or vegetable it represents. As an example, and not a limitation, the air inflow collimator 108 can be colored and shaped like an onion as illustrated in the Figures. In a plurality of other exemplary embodiments, the air inflow collimator 108 can be shaped and textured as other fruit and vegetable shapes such as peppers, as may be required and/or desired in a particular embodiment.

In operation, the airflow is collimated and directionally focused into a continuous air stream 306A-B that is directed from the air inflow collimator 108 by way of the plurality of micro airflow holes 106A and the plurality of macro airflow channels 106B, through the base 104, into the air inflow collimator 108, and outwards from the fan blades 112 through the grill 102. The grill 102 has a plurality of opening slits 182 through which the air 306A-B and airborne eye irritants 308 can pass.

Operationally, in FIG. 2B, in an exemplary embodiment, the fruit or vegetable shaped fan 100 can be positioned to draw air into the fruit or vegetable fan 100, by way of the fan blade 112 away from the work surface 304, such air containing airborne eye irritants 308 that gets released when cutting the onions/peppers 302 or other fruits or vegetables on the work surface 304.

In this regard, the fruit or vegetable shaped fan 100 accelerates and disperses the airborne eye irritants 308 in an airstream 306 away from the user 310. In operation, the fruit or vegetable shaped fan 100 can be positioned with the plurality of micro airflow holes 106A and the plurality of macro airflow channels 106B pointing towards the fruit or vegetable 302 being cut. In this configuration, the airborne eye irritants 308 are harvested from the work surface 304 and enter the rear of the fruit or vegetable fan 100 to be accelerated and dispersed away from the work surface 304 and the user 310 by way of the fan blades 112.

Figure 3A:
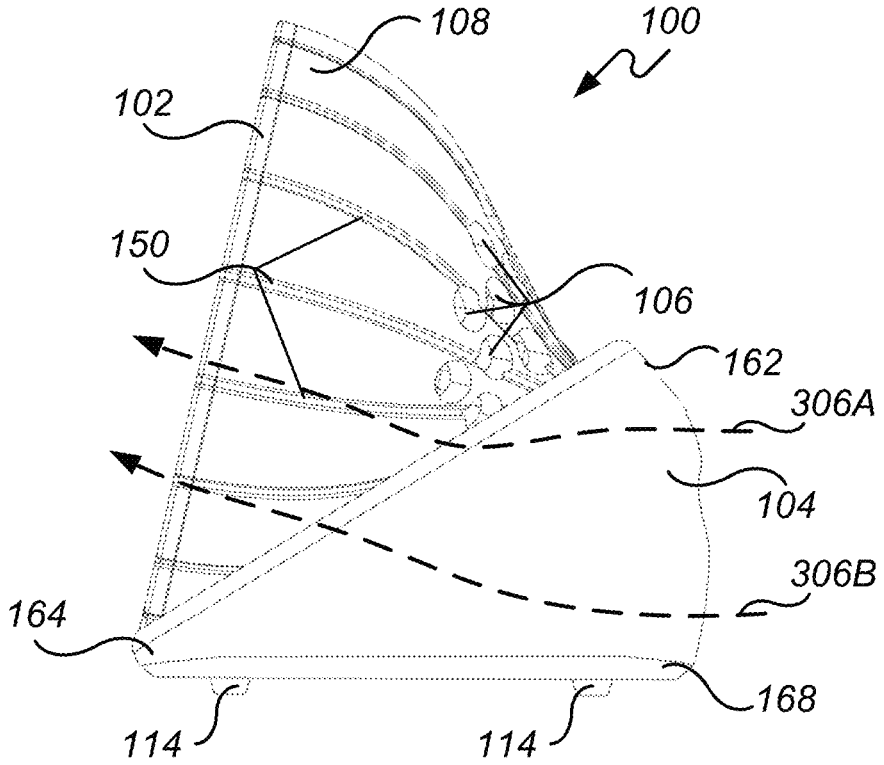
FIGS. 3A and 3B illustrate a right side view of a fruit or vegetable shaped fan and airflow configuration.

Referring to FIG. 3A, there is illustrated a right side view of the fruit or vegetable shaped fan 100. In an exemplary embodiments, the air inflow collimator 108 can be onion-shaped and optionally onion colored. In another exemplary embodiment, the fan body can be a lemon shape, a pepper shape, or other fruits or vegetable shapes, as may be required and/or desired in a particular embodiment. Additionally, in an exemplary embodiment, different fruits and vegetables have different colors allowing the user 310 to select a fruit or vegetable shaped fan 100 that represents the kind of fruits or vegetables they like and/or fruit or vegetable fan 100 color that best matches their food preparation area decor, as may be required and/or desire in a particular embodiment.

In another exemplary embodiment, air grill 102 can be detachable to allow the fan blade 112 located within the air inflow collimator 108, as well as the internal surface of the within the air inflow collimator 108 to be cleaned.

Figure 3B:
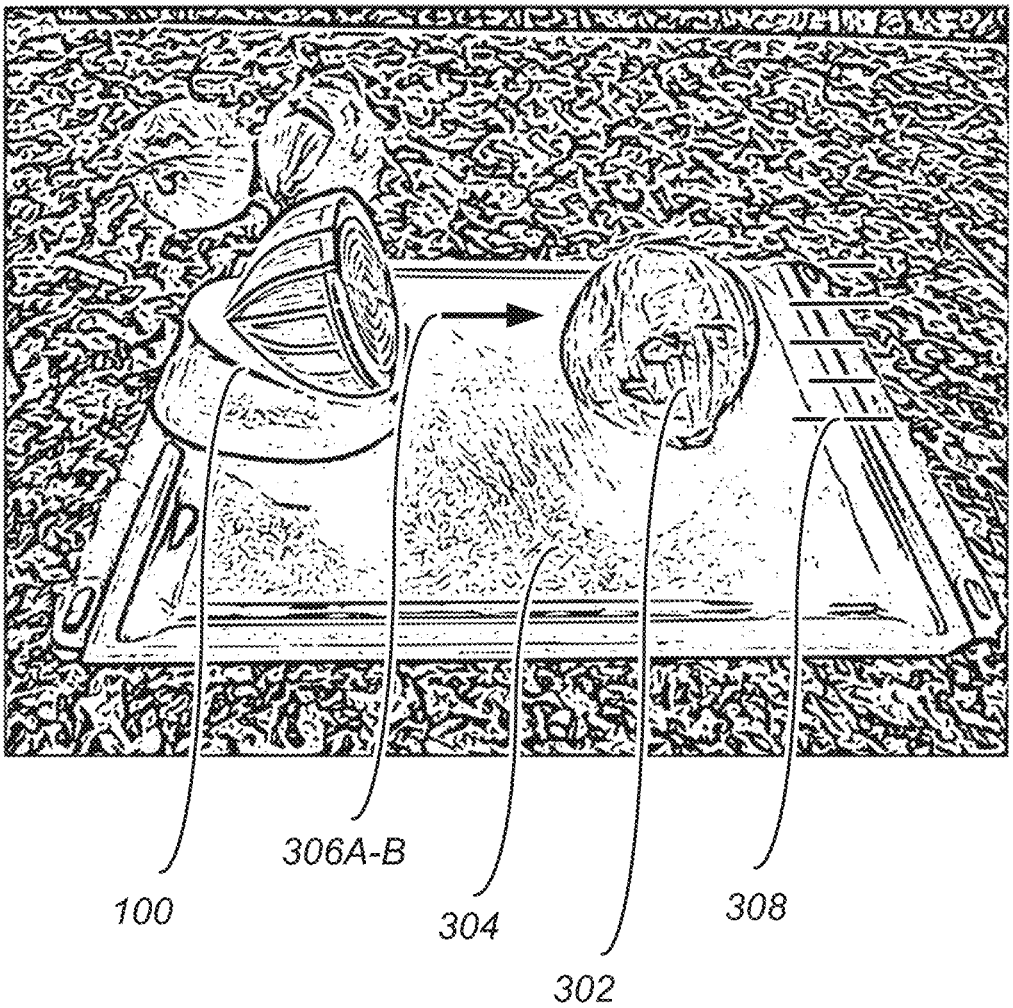
Figure 3B:
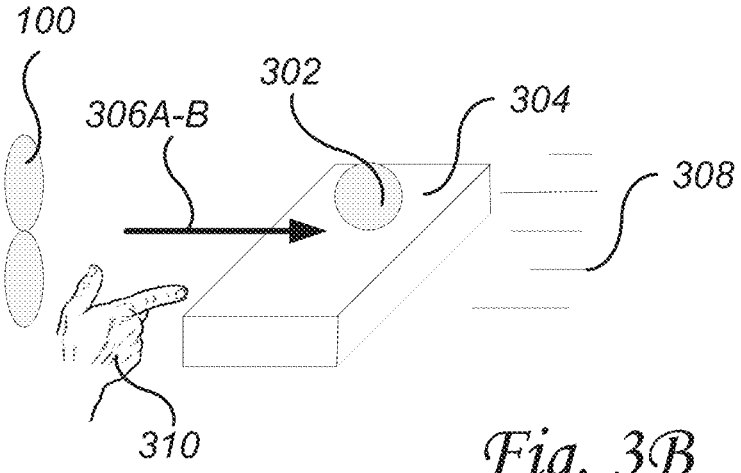

Operationally, in FIG. 3B, in an exemplary embodiment, the fruit or vegetable shaped fan 100 can be positioned such that an airstream 306A-B created by the spinning fan blade 112, is directed across the work surface 304 and past the fruit or vegetable 302 being cut to accelerate and disperse airborne eye irritants 308 away from the work surface 304 and the user 310 who is cutting the fruit or vegetable 302 on the work surface 304. In this regard, the fruit or vegetable shaped fan 100 can be positioned with the plurality of micro airflow holes 106A and the plurality of macro airflow channels 106B pointing away from the fruit or vegetable 302 and the airflow through the grill 112 directed towards the work surface 304 past the fruit or vegetable 302 being cut.

Figure 4:
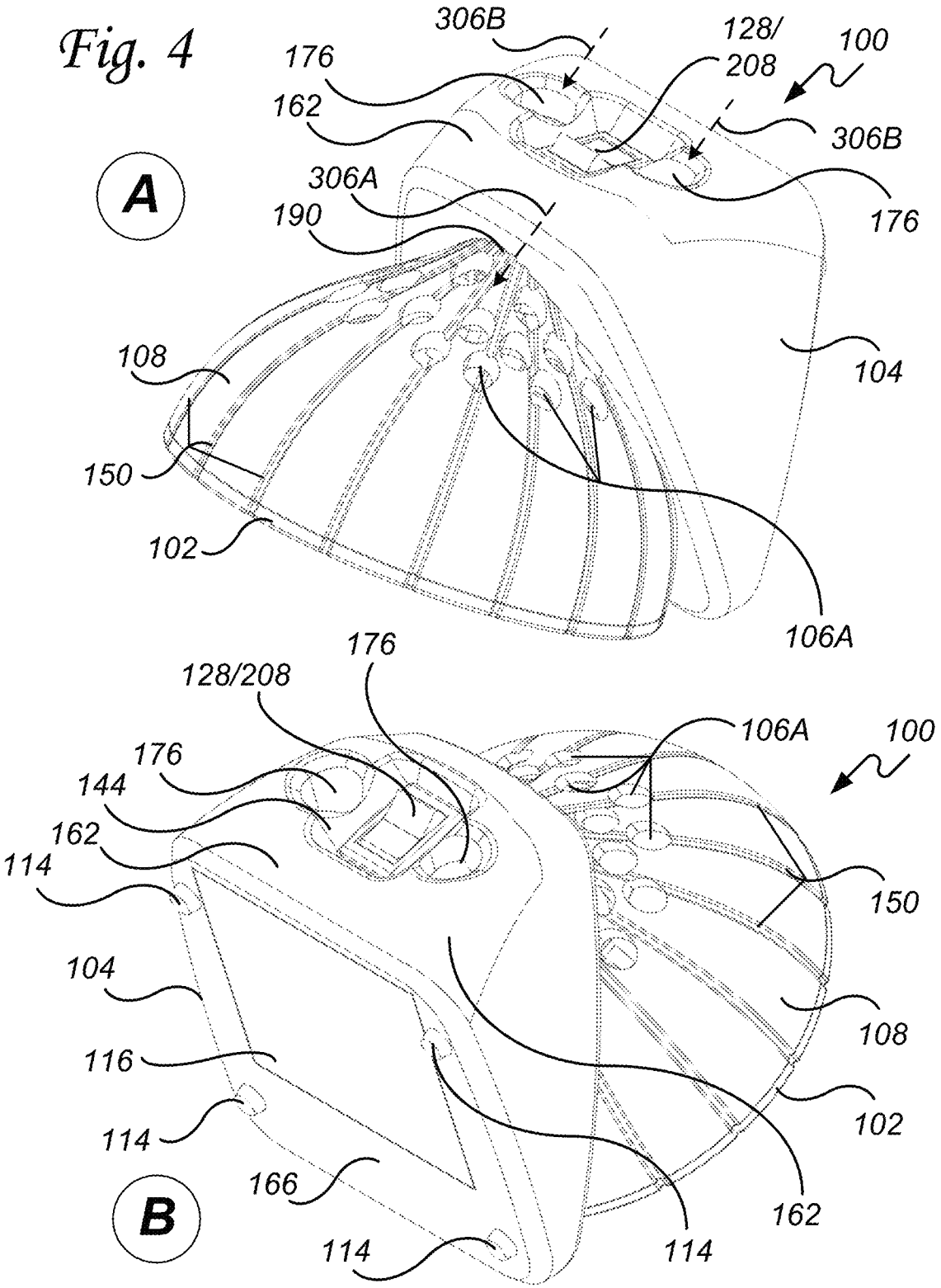
FIG. 4 illustrates a top rear perspective view and a bottom rear perspective view of a fruit or vegetable shaped fan.

Referring to FIG. 4, there is illustrated in reference 'A' a top rear perspective view and reference 'B' a bottom rear perspective view of a fruit or vegetable shaped fan 100. In an exemplary embodiment, a switch 208 can be located and made accessible to user 310 on the base 104. In this regard, the user 310 can toggle the switch 110 'ON' and 'OFF' to operate the fruit or vegetable shaped fan 100.

In an exemplary embodiment, the switch 208 can be a panel mount style that press pit into a switch opening 128 on the base 104. The air inflow collimator 108 can also have a switch opening 184 where the base of the switch 208 can extend into.

In operation, in an exemplary embodiment, the switch 208 can be a toggle 'ON' or 'OFF' type of switch that applies power to the fruit or vegetable shaped fan 100 motor 206 to turn the motor 206 'ON' or 'OFF'.

In operation, in another exemplary embodiment, switch 208 can be a momentary type of switch 208 where the switch is used to turn 'ON' and 'OFF' the fruit or vegetable shaped fan 100 motor 206 by way of a microcontroller 202. In this regard, the fruit or vegetable shaped fan 100 comprises a microcontroller 202, a memory 212, and a switch 208. The memory 212, the motor 206, and the switch 208 are operationally related to the microcontroller 202. The memory 212 is encoded with instructions that when executed by the microcontroller 602 perform the steps of turning 'ON' the motor 206, by way of the microcontroller 202, when the switch 208 is activated. And, turning 'OFF' the motor, by way of the microcontroller 202, when a predetermined amount of time has elapsed. Such a predetermined amount of time can be a fixed number of minutes and seconds or user 310 adjustable number of minutes and seconds, as may be required and/or desired in a particular embodiment.

Figure 5:
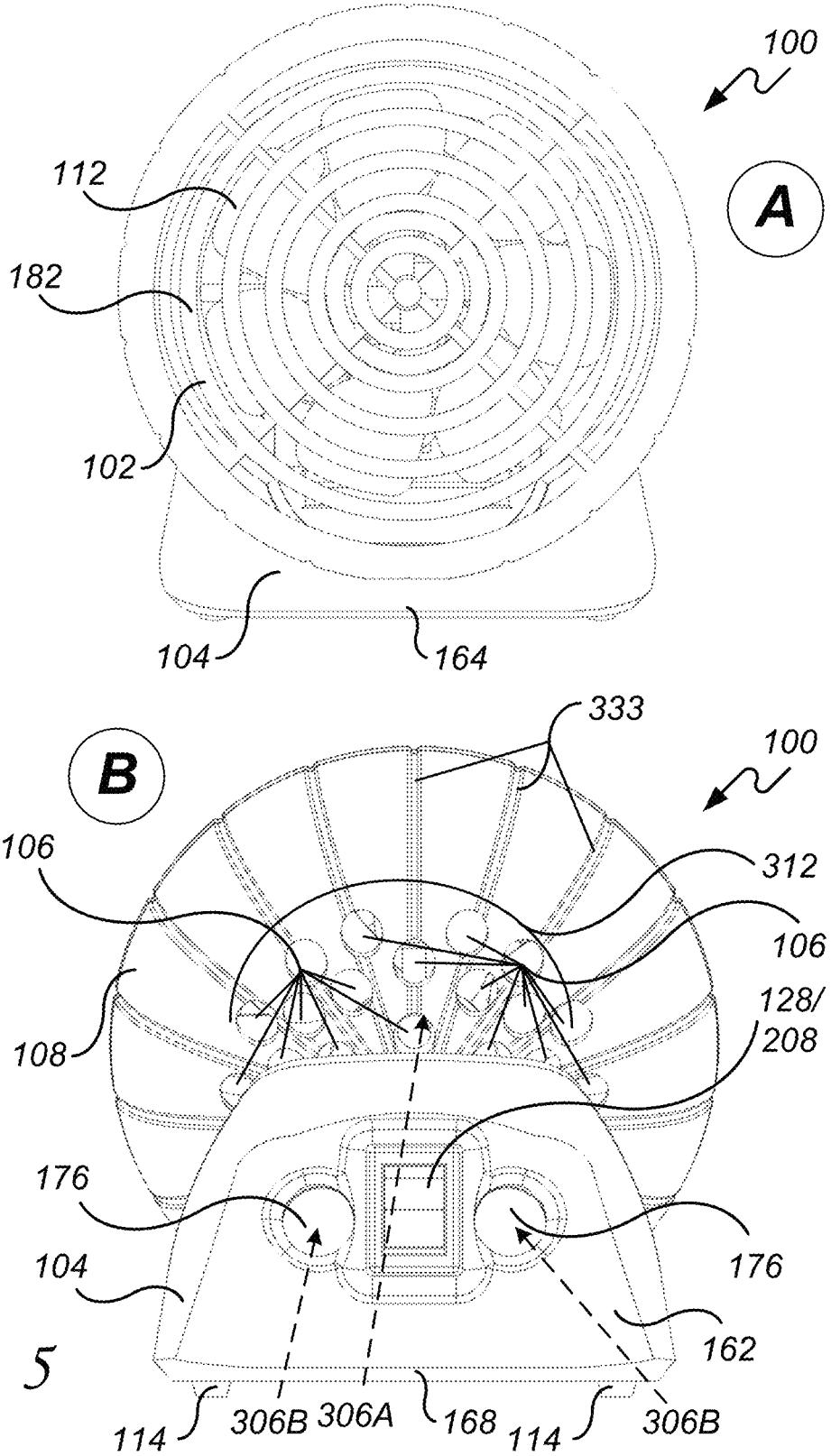
FIG. 5 illustrates one example of a front view and a rear view of a fruit or vegetable shaped fan.

Referring to FIG. 5, there is illustrated one example in reference 'A' is a front view and reference 'B' is a rear view of a fruit or vegetable shaped fan 100. In an exemplary embodiment, the plurality of micro airflow holes 106A is positioned in a semi-circular 312 arrangement proximate to the seam 190 between the mounting attachment 152 and the receiving orifice 146 close to the working surface 304 where the fruit or vegetable shaped fan 100 sits during the cutting of fruits and vegetables 302, drawing eye irritants that originate from cutting the fruits vegetables 302 on the work surface 304 away from a user 310.

Figure 6:
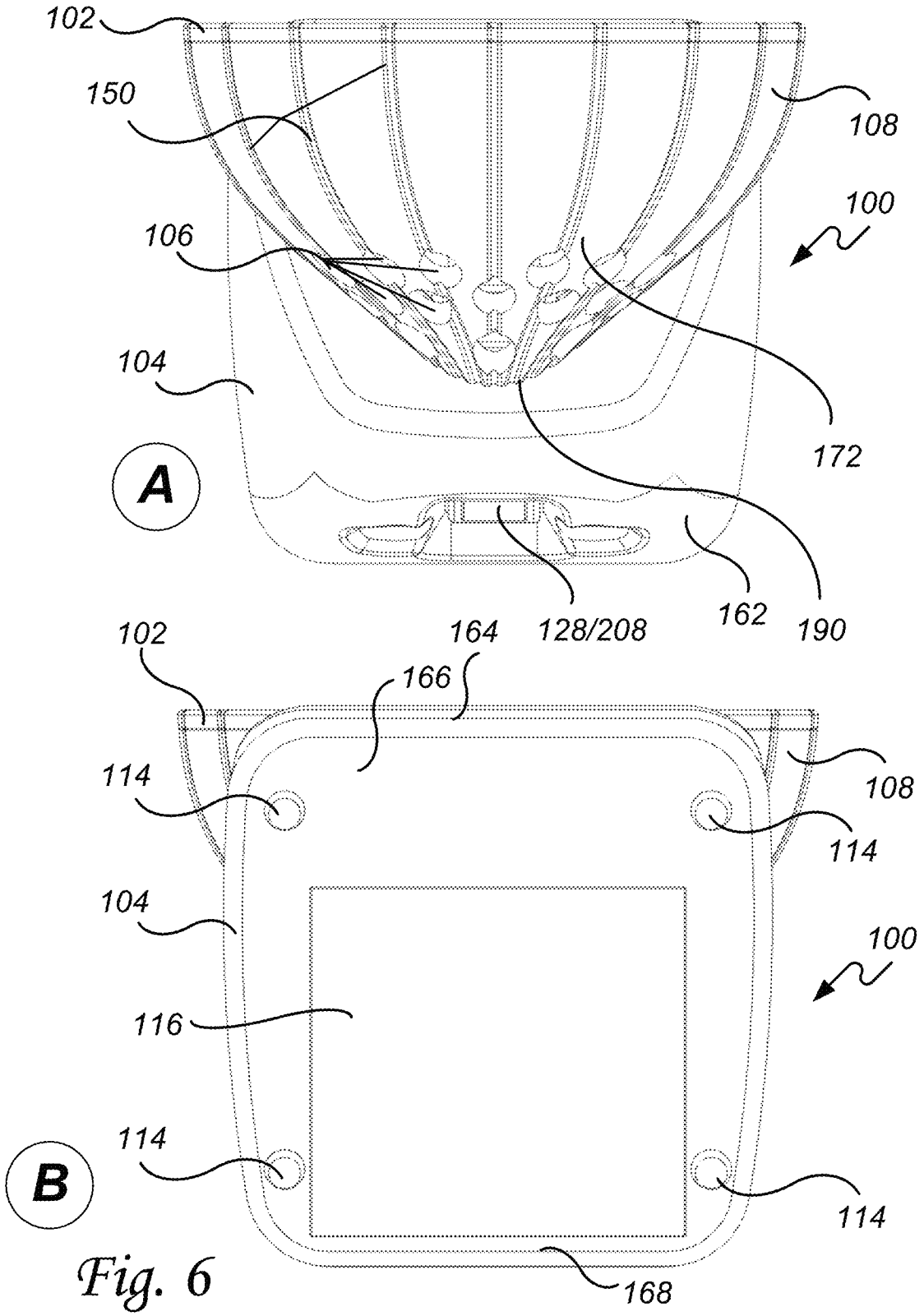
FIG. 6 illustrates one example of a top view and a bottom view of a fruit or vegetable shaped fan.

Referring to FIG. 6, there is illustrated one example of a fruit or vegetable shaped fan 100. In an exemplary embodiment, reference 'A' is a top view, and reference 'B' is a bottom view of a fruit or vegetable shaped fan 100.

Figure 7:
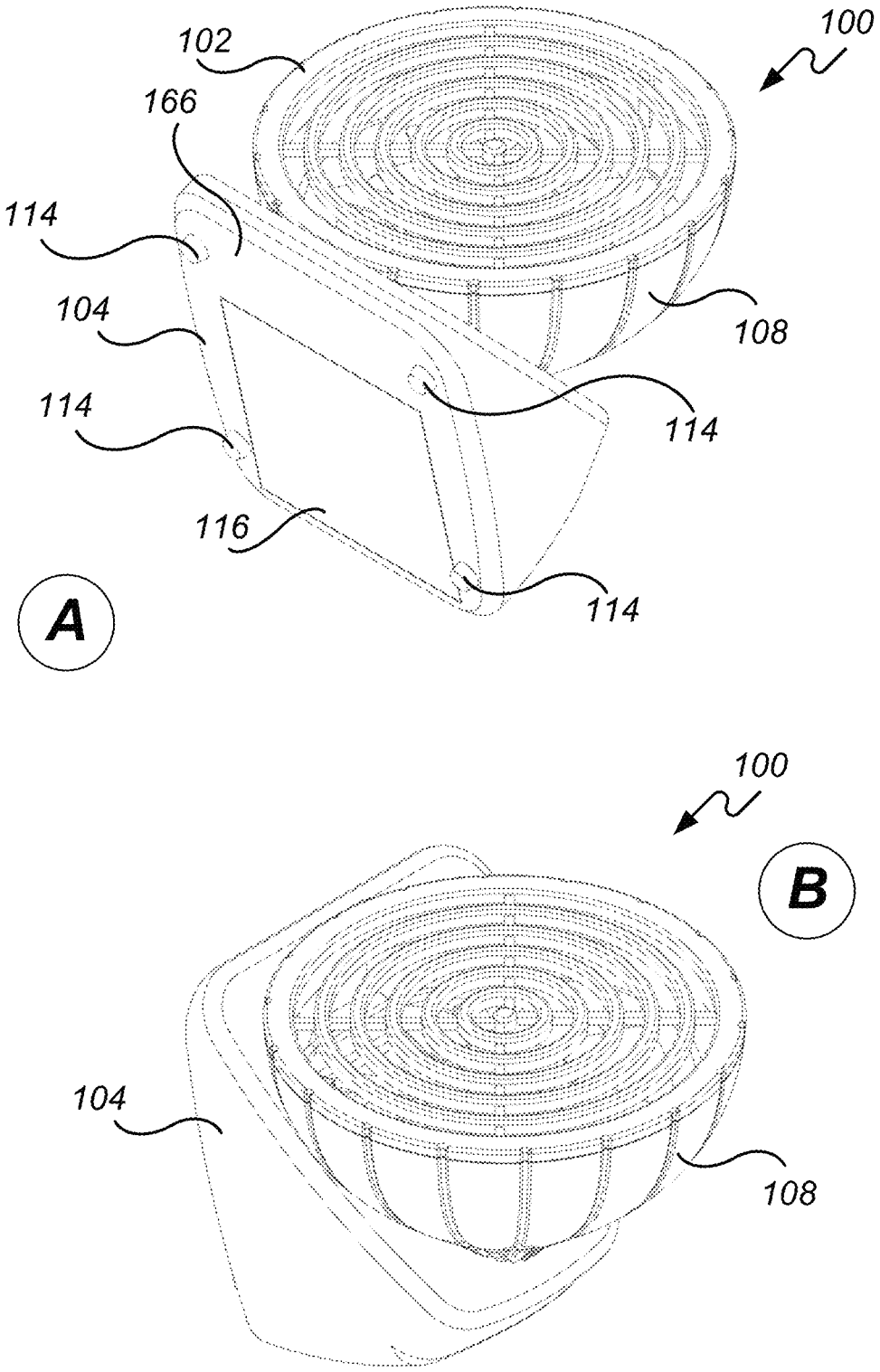
FIG. 7 illustrates one example of a front bottom perspective view and a front top perspective view of a vegetable-shaped fan.

Referring to FIG. 7, there is illustrated one example of a fruit or vegetable shaped fan 100. In an exemplary embodiment, reference 'A' is a front bottom perspective view, and reference 'B' is a front top perspective view of a vegetable-shaped fan.

Referring to FIG. 8, there is illustrated one example of a base 104. In an exemplary embodiment, reference 'A' is a front view of the base 104, reference 'B' is a rear view of the base 104, and reference 'C' is a front right perspective view of the base 104.

In an exemplary embodiment, a fruit or vegetable shaped fan 100 for dispersing airborne eye irritants 308 that are released during the cutting fruits or vegetables 302 comprises a base 104 that is wedge-shaped having a receiving orifice 146 in a front surface 158, a bottom surface 166, and a rear surface 162 having a plurality of macro airflow holes 176. The front surface 158 descends down the wedge shape forming a front edge 164 at the bottom surface 166 that is proximate to a work surface 304 that the fruit or vegetable shaped fan sits on during use.

In an exemplary embodiment, a switch 208 is accessible to user 310. The switch is operationally related to a power supply 204, and motor 206. A battery compartment 126 is integrally formed in the bottom surface 166 of the base 104 and configured to store the power supply 204 for electrical use during the operation of the fruit or vegetable shaped fan 100.

In an exemplary embodiment, the switch 208 can be a panel mount style that press pit into a switch opening 128 on the base 104. The air inflow collimator 108 can also have a switch opening 184 where the base of the switch 208 can extend into.

Referring to FIG. 9, there is illustrated an air inflow collimator 108. In an exemplary embodiment, reference 'A' is a back view of the air inflow collimator 108, reference 'B' is a front view of the air inflow collimator 108, and reference 'C' is a front right perspective view of the air inflow collimator 108.

In an exemplary embodiment, an air inflow collimator 108 is fruit or vegetable shaped and has an open front end 170 and a backend 172. The air inflow collimator 108 forms an interior perimeter 174. The air inflow collimator 108 comprises a fastener mount 154, and a mounting attachment 152 at the backend 172 that is sized and shaped to insert into the receiving orifice 146 of the base 104. The air inflow collimator 108 has a plurality of micro airflow holes 106A positioned in a semi-circular 312 arrangement proximate to the seam 190 between the mounting attachment 152 and the receiving orifice 146 at the backend 172 close to the working surface 304. A plurality of macro airflow channels 106B is disposed through the mounting attachment 152 that aligns with the plurality of macro airflow holes 176 on the rear surface 162 of the base 104.

In this regard, in an exemplary embodiment, the plurality of macro airflow holes 176 in the base 104 aligns with the plurality of macro airflow channels 106B in the air inflow collimator 108 mounting attachment 152 allowing the fan blade 112 to draw air into and through the air inflow collimator 108.

In an exemplary embodiment, the open end 170 of the airflow collimator 108 distends down to the front edge 164 of the base 104 directing egressing airflow from the fan blades 112 across the work surface 304 dispersing airborne eye irritants 308 that are released from cutting of fruits or vegetables 302 on the work surface 304 away from a user 310.

Figure 10:
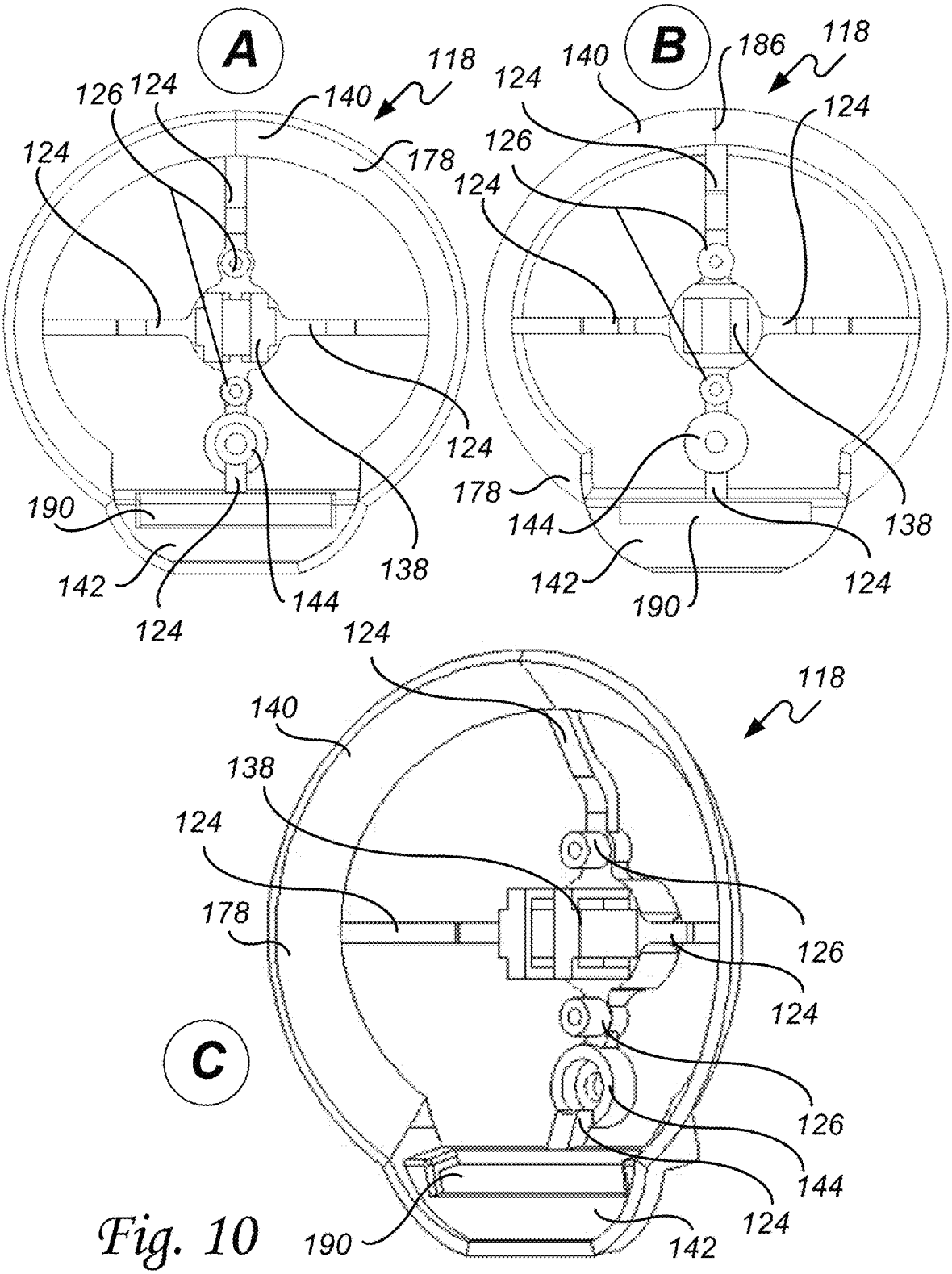
FIG. 10 illustrates one example of an internal frame.

Referring to FIG. 10, there is illustrated one example of an internal frame 118. In an exemplary embodiment, reference 'A' is a front view of an internal frame 118, reference 'B' is a back view of an internal frame 118, and reference 'C' is a front right perspective view of an internal frame 118.

In an exemplary embodiment, an internal frame 118 is configured to provide minimal abatement to airflow through the air inflow collimator 108 by being mostly hollow. The internal frame 118 comprises a perimeter ring 140 that is sized and shaped to fit along a portion of the interior perimeter 174 of the air inflow collimator 108, a plurality of braces 124, a first motor receptacle 138 having at least one of a first motor fastener mount 126, and a fastening ring 144. Each of the plurality of braces 124, the first motor receptacle 138, the first motor fastener mount 126, and the fastening ring 144 are integrally formed into the internal frame 118. The internal frame 118 is fitted into the interior of the air inflow collimator 108 and fastened 148 by way of the fastening ring 144 to the fastener mount 154. Such fastener 148 can be a screw or other types and kinds of fasteners as may be required and/or desired in a particular embodiment.

In an exemplary embodiment, an alignment guide 160 can be formed on the interior surface of the air inflow collimator 108 proximate to the open front end 170. The alignment guide 160 aligns with a frame alignment guide 186 along the perimeter ring 140 to aid in positioning and aligning the internal frame 118 within the air inflow collimator 108.

In this regard, in an exemplary embodiment, the air inflow collimator 108 further comprises an alignment guide 160. The alignment guide 160 engages with a frame alignment guide 186 to orientate the internal frame 118 within the air inflow collimator 108 during assembly. The internal frame 118 comprises the frame alignment guide 186.

In an exemplary embodiment, the lower portion of the perimeter ring 140 has a slot 190 therethrough to promote airflow through the air inflow collimator 108 and past the internal frame 118. In addition, the bottom of the perimeter frame 140 forms a ledge 142 that aligns the internal frame 118 with and positions it against the battery compartment 126 when the fruit or vegetable shaped fan 100 is assembled.

Figure 11:
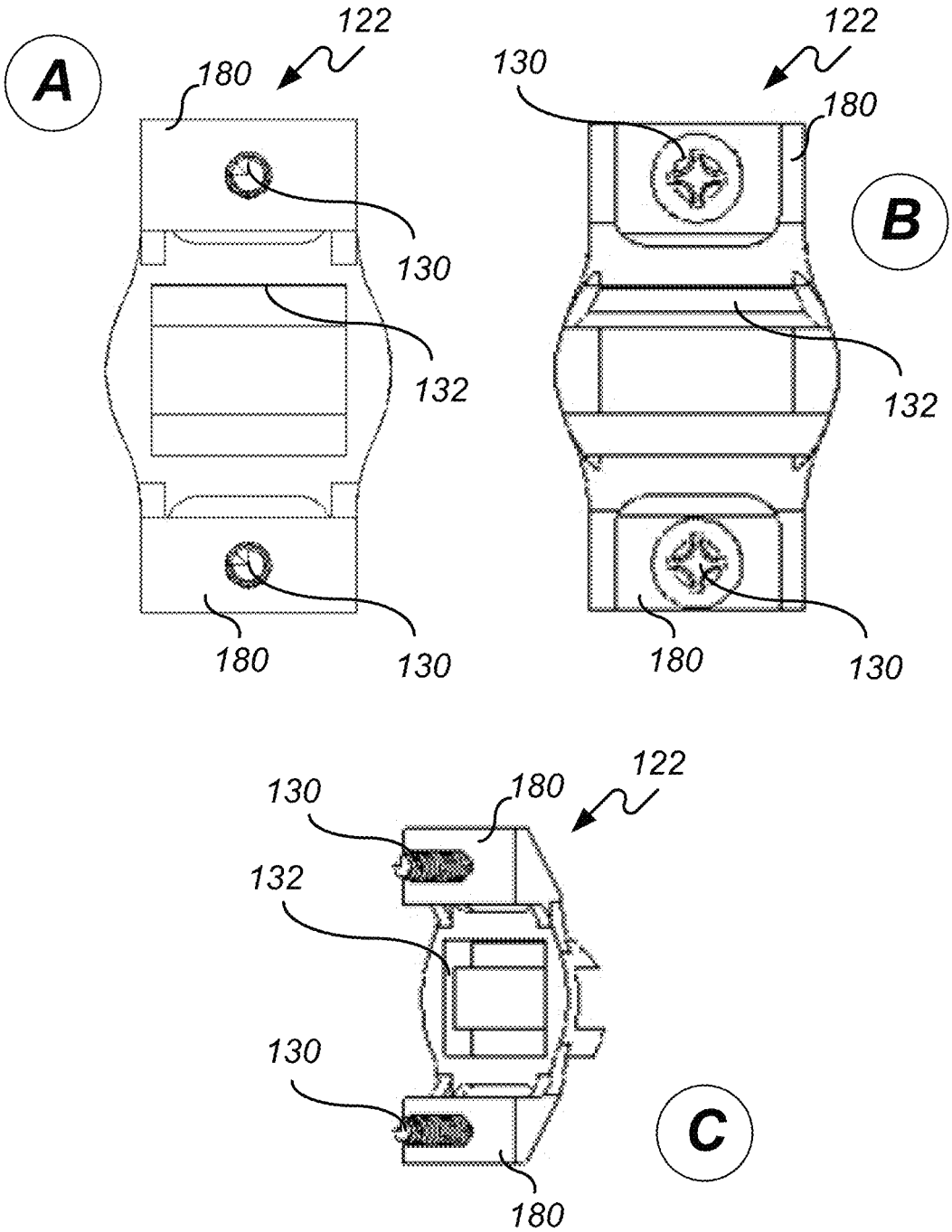
FIG. 11 illustrates one example of a motor mount.

Referring to FIG. 11, there is illustrated one example of a motor mount 122. In an exemplary embodiment, reference 'A' is a front view of a motor mount 122, reference 'B' is a rear view of a motor mount 122, and reference 'C' is a front right perspective view of a motor mount 122.

In an exemplary embodiment, a motor mount 122 comprises a second motor receptacle 132 having at least one of a second motor fastener mount 180. A motor 206 fits between the first motor receptacle 138 in the internal frame 118 and the second motor receptacle 132. The motor mount 122 is secured into place by one or more of a fastener 130 that connects the first motor fastener mount to the second motor fastener mount 180.

Figure 12:
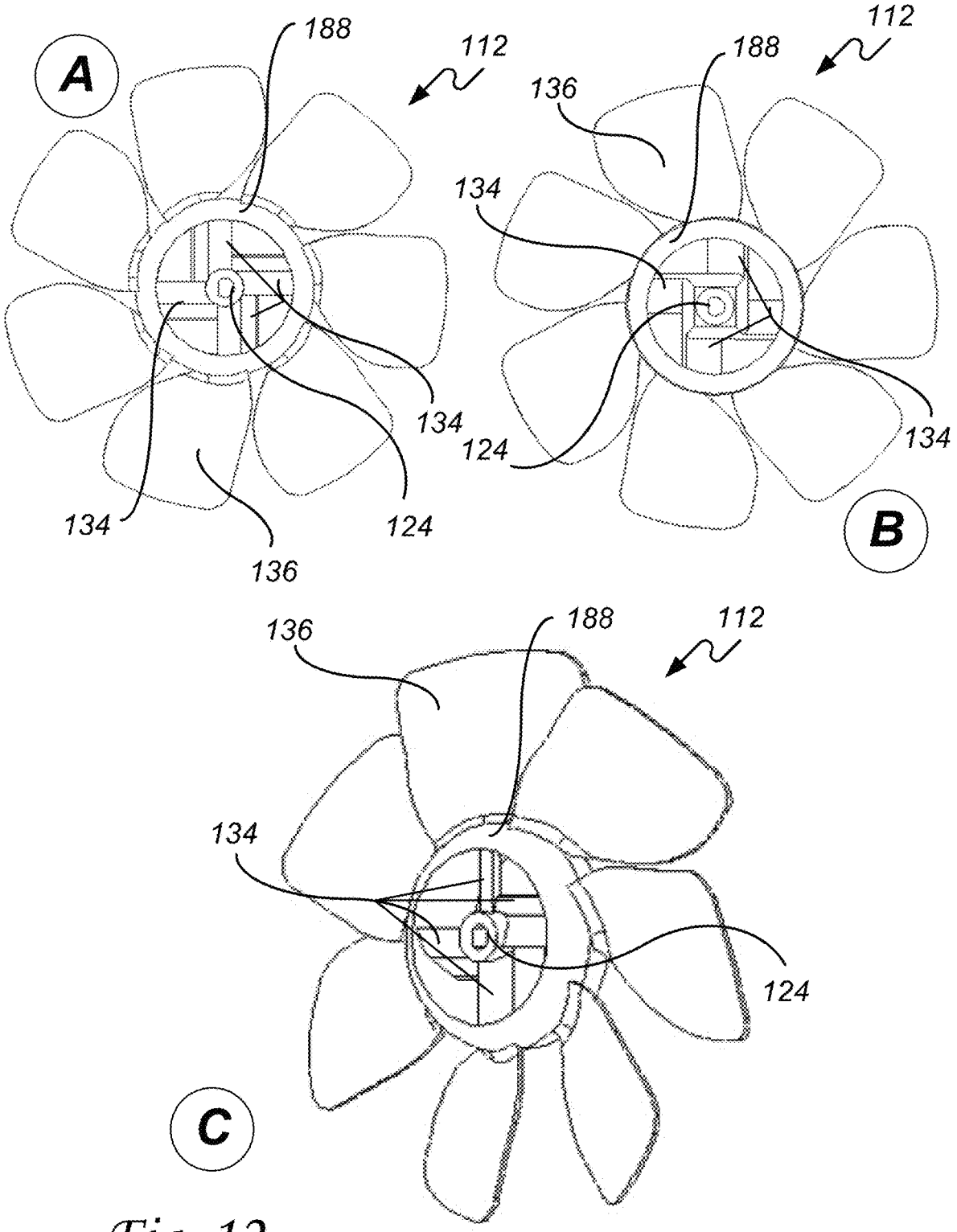
FIG. 12 illustrates one example of a fan blade.

Referring to FIG. 12, there is illustrated one example of a fan blade 112. In an exemplary embodiment, reference 'A' is a front view of a fan blade 112, reference 'B' is a rear view of a fan blade 112, and reference 'C' is a front right perspective view of a fan blade 112.

In an exemplary embodiment, a fan blade 112 attaches to motor 206. A hub 188 is attached to a plurality of blades 136 and a plurality of spokes 134. The plurality of spokes 134 connects to a motor hub 124 located at the center of the fan blade 112. The motor hub 124 attaches to motor 206.

Figure 13:
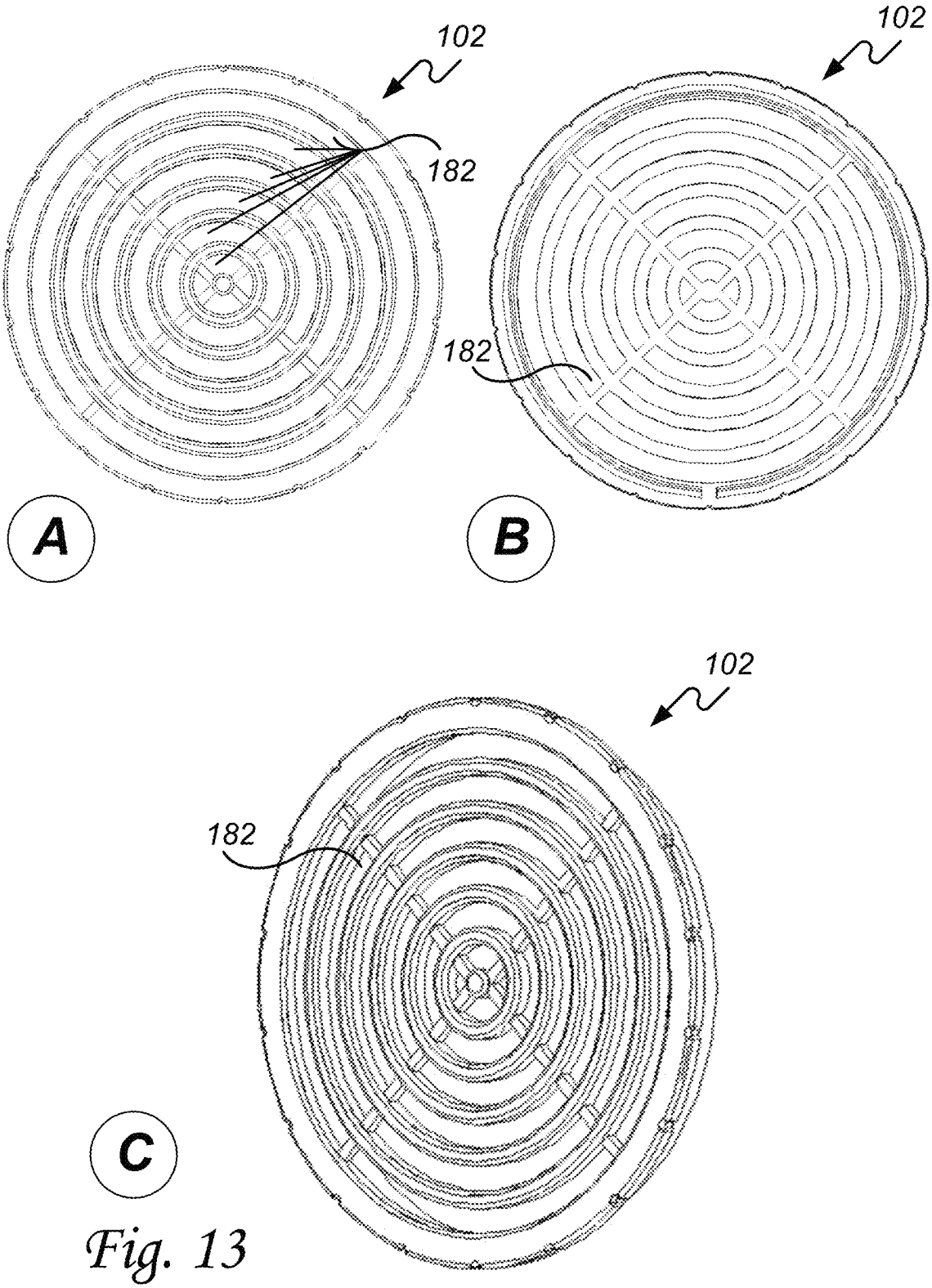
FIG. 13 illustrates one example of a grill.

Referring to FIG. 13, there is illustrated one example of a grill 102. In an exemplary embodiment, reference 'A' is a front view of a grill 102, reference 'B' is a back view of a grill 102, and reference 'C' is a front right perspective view of a grill 102. A grill 102 attaches to the air inflow collimator 108 proximate to the open front end 170 enclosing the internal frame 118, the motor mount 122, the motor 206, and the fan blade 112 inside the air inflow collimator 108. The grill 102 has a plurality of opening slits 182 through which the air 306A-B and airborne eye irritants 308 can pass.

Figure 14A:
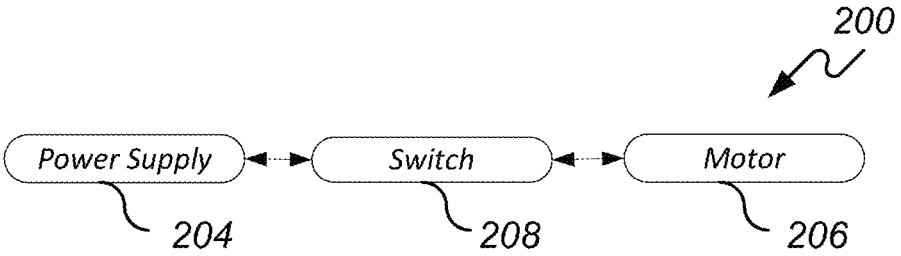
FIGS. 14A and 14B illustrate examples of a system block diagram of electronics for a fruit or vegetable shaped fan.
Figure 14B:
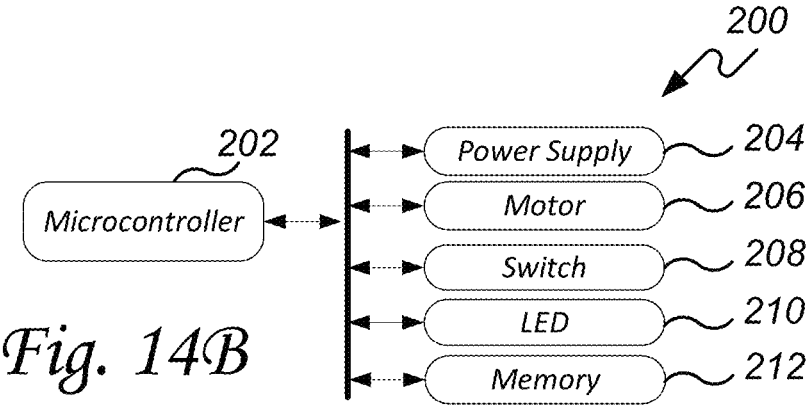

Referring to FIGS. 14A and 14B there are illustrated examples of a system block diagram of electronics 200 for a fruit or vegetable shaped fan 100. For disclosure purposes, the fruit or vegetable shaped fan 100 comprises and is operationally related to the system block diagram electronics 200. Referring to FIG. 14A, in an exemplary embodiment, a power supply 204, a switch 208, and a motor 206 can be interconnected and operationally related. The motor 206 can be interconnected with the fan blade 112 so that when the motor 206 is power 'ON' the fan blade 112 rotates. As such, a user 310 can turn 'ON' and 'OFF'" the fruit or vegetable shaped fan 100 by way of switch 208.

In an exemplary embodiment, the power supply 204 can be an AC wall transformer, batteries, solar panel, AC power, DC power, or other types or kinds of power supplies, as may be required and/or desired in a particular embodiment.

Referring to FIG. 14B, in another exemplary embodiment, a microcontroller 202 can be interconnected with and operationally related to a power supply 204, a motor 206, a switch 208, a light-emitting diode 210, and/or a memory 212. In operation, the memory 212 can be encoded with instructions that when executed by the microcontroller 202 implement the methods of the present invention, as well as execute other methods, as may be required and/or desired in a particular embodiment.

The microcontroller 602 can be INTEL, ZILOG, MICROCHIP, AMD, ARM, and/or other types or kinds of microcontrollers.

The motor 206 can be a direct current (DC) motor or alternating current (AC) motor, or other type or kind of motor, as may be required and/or desired in a particular embodiment. The motor 206 can have a rotor shaft and the fan blade 112 can be attached to the rotor shaft and spin when the motor is 'ON'.

The light-emitting diode (LED) 210 can be configured to display the status of the fruit or vegetable shaped fan 'ON'/'OFF', operate as a battery charging indicator or the LED can be configured and operate for other display purposes, as may be required and/or desired in a particular embodiment.

Memory 614 can be a combination of RAM, ROM, flash, and/or other types and kinds of memory.

Figure 15:
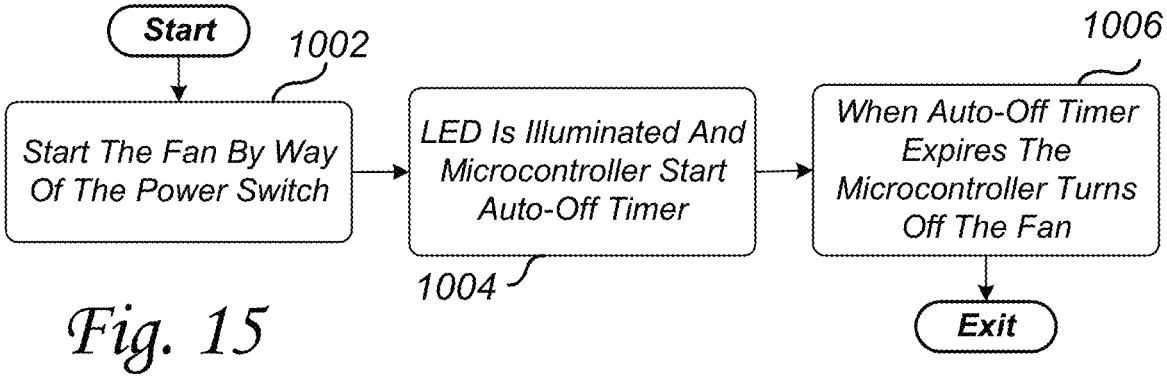
FIGS. 15-16 illustrate examples of a method of using a fruit or vegetable shaped fan to disperse airborne eye irritants that are released during the cutting of fruits or vegetables.

Referring to FIG. 15, there is illustrated one example of a method of using a fruit or vegetable shaped fan 100 to disperse airborne eye irritants 308 that are released during the cutting of fruits or vegetables. In an exemplary embodiment, in step 1002 the fruit or vegetable shaped fan 100 can be started by turning 'ON' the switch 208. Such an action can also provide power or other control signals to the electronics 200. The method then moves to step 1004.

In step 1004, the LED can illuminate as a visual sign the fruit or vegetable shaped fan 100 has been turned 'ON' and the microcontroller 202 can start an auto-off timer. The auto-off timer automatically turns 'OFF" the fruit or vegetable shaped fan 100 after a predetermined time period. The method then moves to step 1006.

In step 1006, when the auto-off timer expires the microcontroller 202 turns 'OFF' the fruit or vegetable shaped fan 100. The method is then exited.

In an exemplary embodiment, the step of turning 'ON' the fruit or vegetable shaped fan 100 further comprises the step of turning 'ON' the motor 206, by way of a microcontroller 202, when a switch 208 is activated, and turning 'OFF' the motor 206, by way of the microcontroller 202, when a predetermined amount of time has elapsed.

Figure 16:
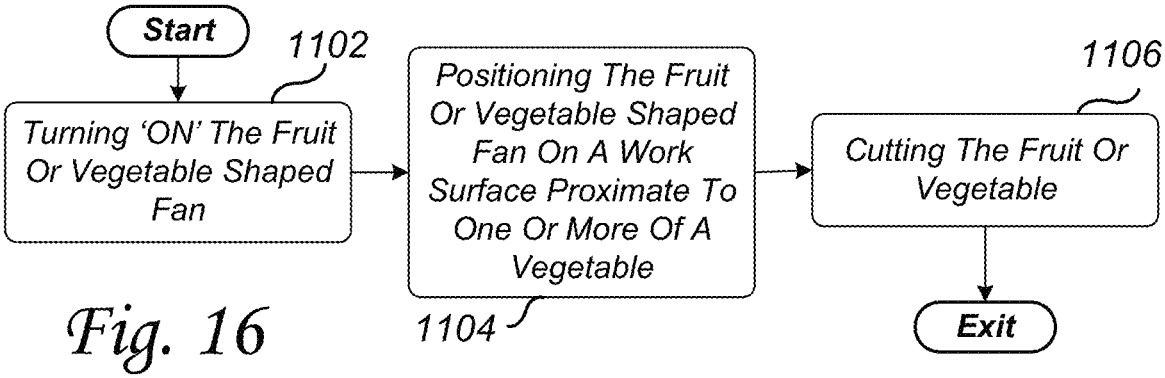

Referring to FIG. 16, there is illustrated one example of a method of using a fruit or vegetable shaped fan 100 to disperse airborne eye irritants 308 that are released during the cutting of fruits or vegetables 302. In an exemplary embodiment, the method begins in step 1102 by turning 'ON' the fruit or vegetable shaped fan 100. The fruit or vegetable shaped fan 100 comprises a base 204 that is wedge-shaped having a receiving orifice 146 in a front surface 158, a bottom surface 166, and a rear surface 162 having a plurality of macro airflow holes 176.

The front surface 158 descends down the wedge shape forming a front edge 164 at the bottom surface 166 that is located proximate to a work surface 304 that the fruit or vegetable shaped fan 100 sits on.

An air inflow collimator 108 is fruit or vegetable shaped and has an open front end 170 and a backend 172. The air inflow collimator 108 forms an interior perimeter 174. The air inflow collimator 108 comprises a fastener mount 154, and a mounting attachment 152 at the backend 172 that is sized and shaped to insert into the receiving orifice 146. The air inflow collimator 108 has a plurality of micro airflow holes 106A disposed proximate the mounting attachment 152 and a plurality of macro airflow channels 106B through the mounting attachment 152 that align with the plurality of macro airflow holes 176 in the base 104.

An internal frame 118 is configured to provide minimal abatement to airflow through the air inflow collimator 108. The internal frame 118 comprises a perimeter ring 140 that is sized and shaped to fit along a portion of the interior perimeter 174, a plurality of braces 124, a first motor receptacle 138 that has at least one of a first motor fastener mount 126, and a fastening ring 144. Each of the plurality of braces 124, the first motor receptacle 138, the first motor fastener mount 126, and the fastening ring 144 are integrally formed into the internal frame 118. The internal frame 118 is fitted into the interior of the air inflow collimator 108 and fastened 148 by way of the fastening ring 144 to the fastener mount 154.

A motor mount 122 comprises a second motor receptacle 132 having at least one of a second motor fastener mount 180. A motor 206 fits between the first motor receptacle 138 in the internal frame 118 and the second motor receptacle 132 in the motor mount 122 and is secured into place by one or more of a fastener 130 that connects the first motor fastener mount 126 to the second motor fastener mount 180.

A fan blade 112 attaches to the motor 206, and a grill 102 attaches to the open front end 170 of the air inflow collimator 108 proximate to the open front end 174 enclosing the internal frame 118, the motor mount 122, the motor 206, and the fan blade 112 inside the air inflow collimator 108. The method then moves to step 1104.

In step 1104, the fruit or vegetable shaped fan 100 is positioned on a work surface 304 proximate to one or more of a fruit or vegetable 302. The method then moves to step 1106.

In step 1106, the fruit or vegetable 302 is cut in a manner that airborne eye irritants 308 are released from the fruit or vegetable 302 and dispersed away from a user 310 by way of the fruit or vegetable shaped fan 100.

Figure 17:
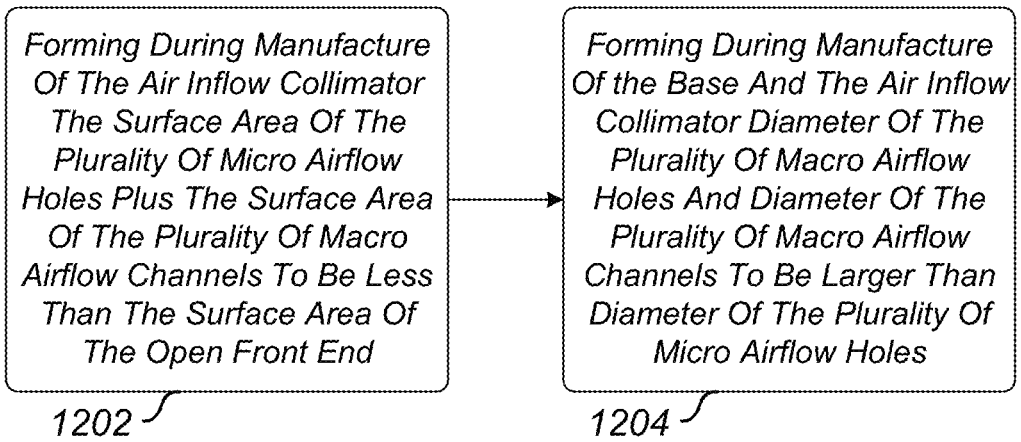
FIG. 17 illustrates exemplary embodiments that can be interchangeably used with the methods of the present invention.

Referring to FIG. 17, there are illustrated exemplary embodiments that can be interchangeably used with the methods of the present invention. In an exemplary embodiment, in step 1202, the fruit or vegetable shaped fan 100 airborne eye irritant 308 dispersion performance can be improved by forming during the manufacture of the air inflow collimator 108 the surface area of the plurality of micro airflow holes 106A plus the surface area of the plurality of macro airflow channels 106B to be less than the surface area of the open front end 170 increasing the velocity of inflow air versus outflow air through the grill 102 causing an increased range of harvest of airborne eye irritants 308 from the work surface 304 and slowing airborne eye irritant 308 dispersion velocity away from a user 310 reducing the chance that dispersing airborne eye irritants 308 unintentionally reaches the eyes of a user 310. The method then moves to step 1204.

In step 1204, forming during the manufacture of the base 104 and the air inflow collimator 108 the diameter of the plurality of macro airflow holes 176 and the diameter of the plurality of macro airflow channels 106B are larger than the diameter of the plurality of micro airflow holes 106A, increasing air inflow through the plurality of macro airflow holes 176 which are located on the rear surface 162 closest to the working surface 304 and the source of airborne eye irritants 308 where the fruit or vegetable shaped fan 100 sits during cutting of fruits or vegetables 302. In this regard, the airborne eye irritants 308 that originate from cutting fruits or vegetables 302 on the work surface 304 are drawn away and dispersed from the user 310.

While the preferred embodiment of the invention has been described, it will be understood that those skilled in the art, both now and in the future, may make various improvements and enhancements.

What is claimed is:

1. A fruit or vegetable shaped fan for dispersing airborne eye irritants that are released during the cutting of fruits or vegetables, the fruit or vegetable shaped fan comprising:

a base that is wedge-shaped and having a receiving orifice on a front surface, a bottom surface, and a rear surface having a plurality of macro airflow holes, the front surface descends down the wedge-shape forming a front edge at the bottom surface that is proximate to a work surface that the fruit or vegetable shaped fan sits on;

an air inflow collimator that is fruit or vegetable shaped and having an open front end and a backend, a grill attaches to the open front end, the air inflow collimator forms an interior perimeter, the air inflow collimator comprises a fastener mount, and a mounting attachment at the backend that is sized and shaped to insert into the receiving orifice, the air inflow collimator having a plurality of micro airflow holes disposed proximate the mounting attachment and a plurality of macro airflow channels through the mounting attachment that align with the plurality of macro airflow holes in the base;

an internal frame that is configured to provide minimal abatement to airflow through the air inflow collimator, the internal frame is fitted into the interior perimeter of the air inflow collimator; and a motor having a fan blade attached is fitted within the internal frame.

2. The fruit or vegetable shaped fan in accordance with claim 1, wherein the plurality of micro airflow holes are positioned in a semi-circular arrangement proximate to a seam between the mounting attachment and the receiving orifice close to the work surface where the fruit or vegetable shaped fan sits during cutting of vegetables drawing eye irritants that originate from cutting vegetables on the work surface away from a user.

3. The fruit or vegetable shaped fan in accordance with claim 2, wherein the diameter of the plurality of macro airflow holes and the diameter of the plurality of macro airflow channels are larger than the diameter of the plurality of micro airflow holes, increasing air inflow through the plurality of macro airflow holes which are located on the rear surface closest to the work surface and the source of airborne eye irritants where the fruit or vegetable shaped fan sits during cutting of fruits or vegetables.

4. The fruit or vegetable shaped fan in accordance with claim 3, wherein the surface area of the plurality of micro airflow holes plus the surface area of the plurality of macro airflow channels is less than the surface area of the open front end, increasing the velocity of inflow air versus outflow air through the grill causing an increased range of harvest of airborne eye irritants from the work surface and slowing airborne eye irritant dispersion velocity away from a user reducing the chance that the dispersing airborne eye irritants unintentionally reach eyes of the user.

5. The fruit or vegetable shaped fan in accordance with claim 4, wherein the open front end of the airflow collimator distends down to the front edge of the base directing egressing airflow from the fan blades across the work surface, dispersing airborne eye irritants, that originate from cutting of fruits or vegetables on the work surface.

6. The fruit or vegetable shaped fan in accordance with claim 5, wherein the air inflow collimator is shaped like an onion or a pepper.

7. The fruit or vegetable shaped fan in accordance with claim 1, further comprising:

a switch that is accessible to a user, the switch is operationally related to a power supply, and the motor; and a battery compartment is integrally formed in the bottom surface of the base and configured to store the power supply for electrical use during the operation of the fruit or vegetable shaped fan.

8. The fruit or vegetable shaped fan in accordance with claim 1, wherein the air inflow collimator further comprises an alignment guide, the alignment guide engages with a frame alignment guide to orientate the internal frame within the air inflow collimator during assembly, the internal frame comprises the frame alignment guide.

9. The fruit or vegetable shaped fan in accordance with claim 1, further comprising:

a microcontroller, a memory, and a switch, the memory, the motor, and the switch are operationally related to the microcontroller, the memory is encoded with instructions that when executed by the microcontroller perform the steps of:

turning on the motor, by way of the microcontroller, when the switch is activated; and turning off the motor, by way of the microcontroller, when a predetermined amount of time has elapsed.

10. A fruit or vegetable shaped fan for dispersing airborne eye irritants that are released during the cutting of fruits or vegetables, the fruit or vegetable shaped fan comprising:

a base that is wedge-shaped and having a receiving orifice on a front surface, a bottom surface, and a rear surface having a plurality of macro airflow holes, the front surface descends down the wedge-shape forming a front edge at the bottom surface that is proximate to a work surface that the fruit or vegetable shaped fan sits on;

an air inflow collimator that is fruit or vegetable shaped and having an open front end and a backend, the air inflow collimator forms an interior perimeter, the air inflow collimator comprises a fastener mount, and a mounting attachment at the backend that is sized and shaped to insert into the receiving orifice, the air inflow collimator having a plurality of micro airflow holes positioned in semi-circular arrangement proximate to a seam between the mounting attachment and the receiving orifice at the backend close to the work surface, and a plurality of macro airflow channels through the mounting attachment that align with the plurality of macro airflow holes on the rear surface; and an internal frame that is configured to provide minimal abatement to airflow through the air inflow collimator, the internal frame is fitted into the interior perimeter of the air inflow collimator, and a motor having a fan blade attached fits in the internal frame;

wherein the diameter of the plurality of macro airflow holes and the diameter of the plurality of macro airflow channels are larger than the diameter of the plurality of micro airflow holes, the plurality of macro airflow holes inlets are on the rear surface and positioned close to the work surface where the fruit or vegetable shaped fan sits during cutting of fruits or vegetables, drawing eye irritants that originate from cutting fruits or vegetables on the work surface away from a user.

11. The fruit or vegetable shaped fan in accordance with claim 10, wherein the internal frame comprises a perimeter ring that is sized and shaped to fit along a portion of the interior perimeter, a plurality of braces, a first motor receptacle having at least one of a first motor fastener mount, and a fastening ring, each of the plurality of braces, the first motor receptacle, the first motor fastener mount, and the fastening ring are integrally formed into the internal frame, the internal frame is fitted into the interior perimeter of the air inflow collimator and fastened by way of the fastening ring to the fastener mount;

the fruit or vegetable shaped fan further comprising:

a motor mount comprises a second motor receptacle having at least one of a second motor fastener mount, the motor fits between the first motor receptacle and the second motor receptacle and is secured into place by one or more of a fastener that connects the first motor fastener mount to the second motor fastener mount; and a grill attaches to the open front end of the air inflow collimator enclosing the internal frame, the motor mount, the motor, and the fan blade inside the air inflow collimator.

12. The fruit or vegetable shaped fan in accordance with claim 10, wherein the surface area of the plurality of micro airflow holes plus the surface area of the plurality of macro airflow channels is less than the surface area of the open front end, increasing the velocity of inflow air versus outflow air through the grill causing an increased range of harvest of airborne eye irritants from the work surface and slowing airborne eye irritant dispersion velocity away from the user reducing the chance that the dispersing airborne eye irritants unintentionally reach eyes of the user.

13. The fruit or vegetable shaped fan in accordance with claim 10, wherein the air inflow collimator is shaped like an onion or a pepper.

14. The fruit or vegetable shaped fan in accordance with claim 11, wherein the open front end of the airflow collimator distends down to the front edge of the base directing egressing airflow from the fan blades across the work surface, dispersing airborne eye irritants, away that originate from cutting of fruits or vegetables on the work surface, away from the user.

15. The fruit or vegetable shaped fan in accordance with claim 10, further comprising:

a switch that is accessible to the user, the switch is operationally related to a power supply, and the motor; and a battery compartment is integrally formed in the bottom surface of the base and configured to store the power supply for electrical use during the operation of the fruit or vegetable shaped fan.

16. The fruit or vegetable shaped fan in accordance with claim 10, wherein the air inflow collimator further comprises an alignment guide, the alignment guide engages with a frame alignment guide to orientate the internal frame within the air inflow collimator during assembly, the internal frame comprises the frame alignment guide.

17. The fruit or vegetable shaped fan in accordance with claim 10, further comprising:

a microcontroller, a memory, and a switch, the memory, the motor, and the switch are operationally related to the microcontroller, the memory is encoded with instructions that when executed by the microcontroller perform the steps of:

turning on the motor, by way of the microcontroller, when the switch is activated; and turning off the motor, by way of the microcontroller, when a predetermined amount of time has elapsed.

18. A method of using a fruit or vegetable shaped fan to disperse airborne eye irritants that are released during the cutting of fruits or vegetables, the method comprising the steps of:

turning on the fruit or vegetable shaped fan, the fruit or vegetable shaped fan comprising a base that is wedge shaped and having a receiving orifice on a front surface, a bottom surface, and a rear surface having a plurality of macro airflow holes, the front surface descends down the wedge shape forming a front edge at the bottom surface that is proximate a work surface the fruit or vegetable shaped fan sits on, an air inflow collimator that is fruit or vegetable shaped and having an open front end and a backend, a grill attaches to the open front end, the air inflow collimator forms an interior perimeter, the air inflow collimator comprises a fastener mount, and a mounting attachment at the backend that is sized and shaped to insert into the receiving orifice, the air inflow collimator having a plurality of micro airflow holes disposed proximate the mounting attachment and a plurality of macro airflow channels through the mounting attachment that align with the plurality of macro airflow holes, an internal frame that is configured to provide minimal abatement to airflow through the air inflow collimator, the internal frame is fitted into the interior perimeter of the air inflow collimator, a motor having a fan blade attached is fitted within the internal frame;

positioning the fruit or vegetable shaped fan on a work surface proximate to one or more of a fruit or vegetable; and cutting the fruit or vegetable in a manner that airborne eye irritants are released from the fruit or vegetable and dispersed away from a user by way of the fruit or vegetable shaped fan.

19. The method in accordance with claim 18, wherein the step of:

turning on the fruit or vegetable shaped fan further comprises the step of turning on the motor, by way of a microcontroller, when a switch is activated, and turning off the motor, by way of the microcontroller, when a predetermined amount of time has elapsed.

20. The method in accordance with claim 18, further comprising the steps of:

improving the fruit or vegetable shaped fan airborne eye irritant dispersion performance by:

forming during the manufacture of the air inflow collimator the surface area of the plurality of micro airflow holes plus the surface area of the plurality of macro airflow channels to be less than the surface area of the open front end, increasing the velocity of inflow air versus outflow air through the grill causing increased range of harvest of airborne eye irritants from the work surface and slowing airborne eye irritant dispersion velocity away from the user reducing the chance that the dispersing airborne eye irritants unintentionally reach eyes of the user; and forming during the manufacture of the base and the air inflow collimator diameter of the plurality of macro airflow holes and diameter of the plurality of macro airflow channels to be larger than the diameter of the plurality of micro airflow holes, increasing air inflow through the plurality of macro airflow holes which are located on the rear surface closest to the work surface and the source of airborne eye irritants where the fruit or vegetable shaped fan sits during cutting of fruits or vegetables;

wherein airborne eye irritants that originate from cutting fruits or vegetables on the work surface are drawn away and dispersed from the user.

* * * * *